US005290077A

United States Patent [19]

Fleming

[11] Patent Number: 5,290,077

[45] Date of Patent: Mar. 1, 1994

[54] MULTIPOINT DOOR LOCK ASSEMBLY

[75] Inventor: Paul D. Fleming, Glendale, Calif.

[73] Assignee: W&F Manufacturing, Inc., Glendale, Calif.

[21] Appl. No.: 822,053

[22] Filed: Jan. 14, 1992

[51] Int. Cl.[5] ..... E05C 1/06

[52] U.S. Cl. ..... 292/35; 70/108; 292/37; 292/DIG. 60; 292/341.11

[58] Field of Search ..... 70/95, 452, 143, 107, 70/108, 143, 113; 292/37, 35, 34, 45, 244, 341.11, DIG. 60; D8/301, 302

[56] References Cited

U.S. PATENT DOCUMENTS

| | | | |
|---|---|---|---|
| 1,427,991 | 9/1922 | Whittaker | 292/341.11 |
| 4,156,541 | 5/1979 | Babb, Jr. et al. | 70/108 |
| 4,227,723 | 10/1980 | Rosell | 292/34 |
| 4,255,953 | 3/1981 | Dietrich et al. | 70/107 |
| 4,391,460 | 7/1983 | Bonet | 292/37 |
| 4,643,005 | 2/1987 | Logas | 70/95 |
| 4,671,089 | 6/1987 | Fleming et al. | 70/452 |
| 4,754,624 | 7/1988 | Fleming et al. | 70/95 |
| 4,943,737 | 8/1990 | Hart | 70/143 |
| 4,962,653 | 10/1990 | Kaup | 70/108 |
| 4,964,660 | 10/1990 | Prevot et al. | 292/37 |
| 4,988,133 | 1/1991 | Shih | 292/244 |
| 5,058,938 | 10/1991 | Döring et al. | 292/45 |

FOREIGN PATENT DOCUMENTS 1559712 10/1969 Fed. Rep. of Germany .

*Primary Examiner*—Eric K. Nicholson

*Attorney, Agent, or Firm*—Kelly, Bauersfeld & Lowry

[57] ABSTRACT

A door lock assembly is provided for secure multipoint locking of a door. The lock assembly comprises a main lock cartridge in combination with one or more remote secondary lock cartridges mounted at one side edge of a door, with the main lock cartridge having an actuator for manipulating a plurality of lock members. In one preferred form for use with a hinged or swinging door, the lock members comprise a plurality of latch bolts movable to a first extended position for normal door latching, or to a second and further extended position to function as multiple deadbolts. In an alternate preferred form for use with a sliding door, the lock members comprise headed latch pins for engaging keeper plates on the adjacent door jamb. In either embodiment, the door jamb may comprise the adjacent side edge of a second or semi-active door in a double door entry set, wherein the second door desirably includes a header-sill lock assembly which is maintained in a positively locked condition unless the adjacent door is opened.

36 Claims, 22 Drawing Sheets

FIG. 6
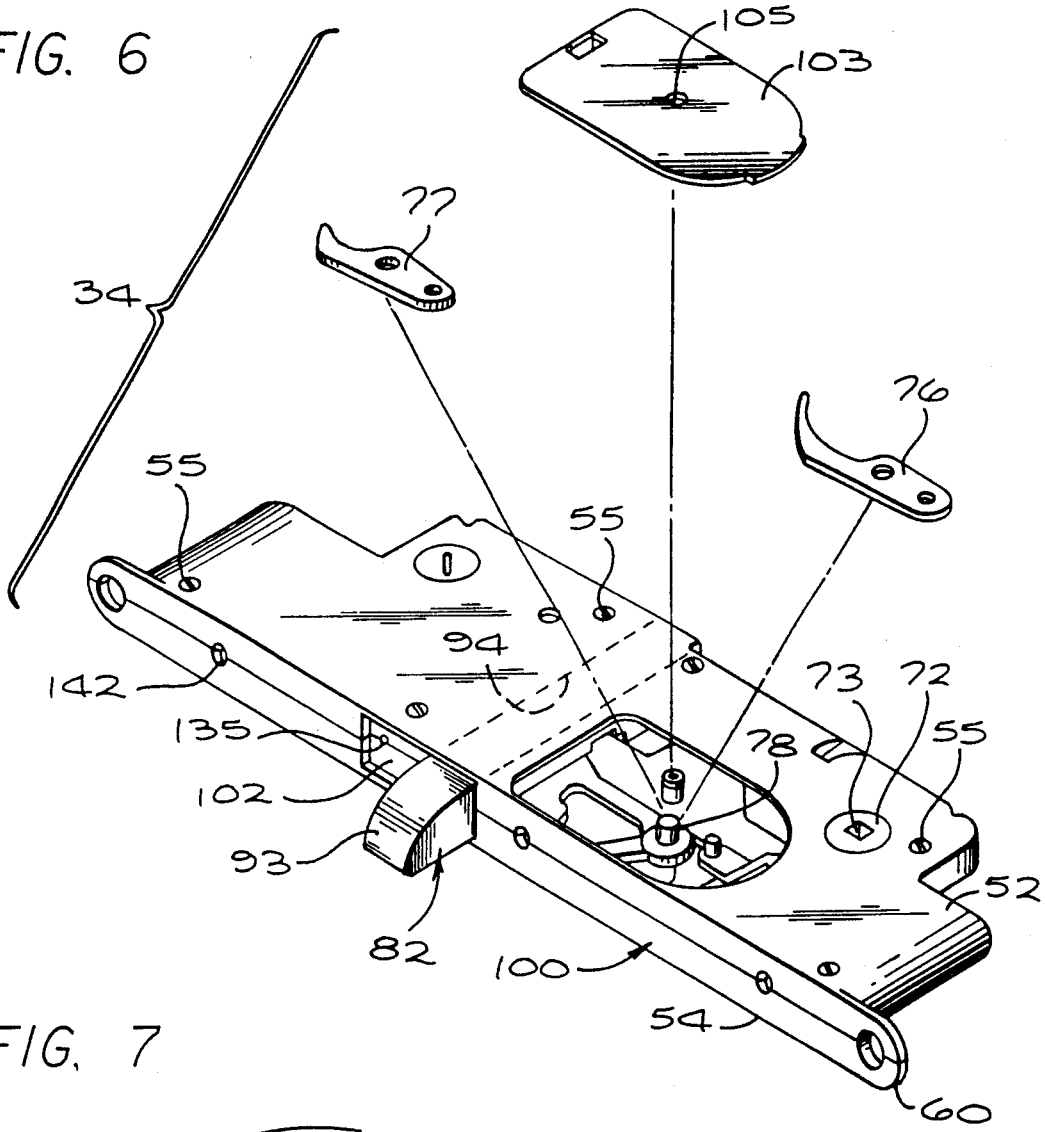
FIG. 7
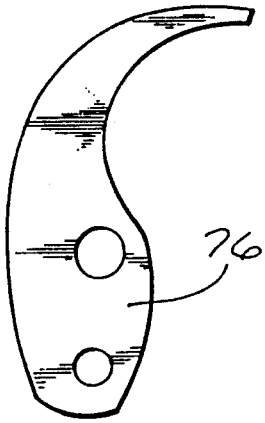
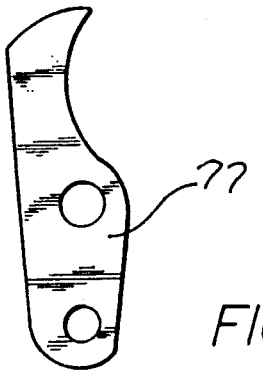
FIG. 8

MULTIPOINT DOOR LOCK ASSEMBLY

BACKGROUND OF THE INVENTION

This invention relates generally to an improved door lock assembly for secure multipoint locking of a door, particularly such as an entry door for a residence or business establishment. The improved door lock assembly is adapted for use with hinged or sliding doors, while providing multiple movable lock members which can be installed quickly and easily for coordinated operation from a single or main actuator.

Door lock assemblies for use with hinged swinging doors, or for use with sliding doors are generally known in the art. Such lock assemblies typically include one or more movable lock members mounted at a vertical position along one side edge of the door in close proximity to an actuator positioned for convenient manual operation. For example, in a hinged or swinging door, a spring-loaded latch bolt is normally mounted at a mid-height position to engage a strike or keeper plate on an adjacent door jamb to maintain the door in a closed and/or locked condition. A handle or lever is normally included as a part of the lock assembly and is adapted for manual operation to retract the latch bolt and thereby permit the door to be opened. A deadbolt is frequently associated with the latch bolt for extension or retraction by means of a keyed cylinder or manually operated thumbturn or the like. Similarly, in a sliding door adapted for sliding movement back-and-forth upon a lower track or rail, a lock member is normally mounted at one side edge of the door for manual operation by means of a lever or similar actuator to releasibly engage a strike or keeper plate on an adjacent door jamb.

Although conventional door lock assemblies as described above have performed their latching or and/or locking functions in a generally satisfactory manner, there is a continuing desire and need for further improvements in high security lock assemblies designed to safely and positively lock a door against unauthorized entry. Toward this end, so-called multipoint lock assemblies have been proposed wherein multiple lock members are provided along the side edge of a door for engaging a corresponding number of keeper plates mounted on an adjacent door jamb. In some cases, the multiple lock members are designed for independent actuation, with the unfortunate result that frequently only one of the lock members is engaged due to human forgetfulness and/or neglect. In other designs, the multiple lock members are adapted for concurrent actuation from a single actuator lever or handle, but these systems have tended to be relatively difficult to assemble and install in a cost effective manner.

Moreover, although multipoint lock assemblies are frequently preferred where a higher degree of security is required or desired, multipoint lock assemblies designed for use with a swinging door have not been suitable for use with a sliding door, and visa versa. Accordingly, it has been necessary to provide different lock assembly designs to accommodate the unique operative requirements of hinged doors and sliding doors.

The present invention overcomes the problems and disadvantages encountered in the prior art by providing an improved multipoint lock assembly which can be assembled and installed into the side edge of a door both quickly and easily, with multiple lock members providing secure and safe positive locking of the door against unauthorized entry. The lock assembly includes a main lock cartridge which can be adapted for use with a hinged door or for use with a sliding door.

SUMMARY OF THE INVENTION

In accordance with the invention, an improved multipoint door lock assembly is adapted for use with a swinging door or for use with a sliding door to provide secure multipoint locking. The lock assembly includes a main lock cartridge having an actuator for operating a plurality of remotely positioned lock members mounted at vertically spaced locations along the door side edge. The particular design of the lock members is selected to accommodate secure locking requirements of a swinging door or a sliding door, as appropriate.

More specifically, in one preferred form of the invention for use in a swinging door application, the main lock cartridge includes an actuator drive bar mounted for vertical reciprocation in response to rotation of lever handles at the indoor and outdoor sides of the door. The actuator bar carries cam rollers engaged within cam tracks on a latch bolt for displacing the latch bolt between a retracted position and a first or normal extended position for door latching.

A deadbolt thumbturn is also provided as part of the main lock cartridge for displacing a cam plate back-and-forth with respect to the actuator drive bar. Additional cam rollers on the actuator drive bar are engaged within cam tracks defined by said cam plate. In one position of the thumbturn, the cam plate permits unrestricted displacement of the latch bolt between the retracted and normal first positions, as described above. In a second position, the thumbturn shifts the cam plate in a manner which also shifts the actuator drive bar to displace the latch bolt to a further extended or second position. In this second position, the latch bolt functions as a deadbolt, with the actuator drive bar being shifted beyond a range of engagement with a drive linkage associated with the outdoor lever handle, such that rotation of the outdoor handle is ineffective to retract the latch bolt.

The actuator drive bar is adapted for relatively simple connection to extension rods which project through channels formed within the door stile to remotely mounted secondary lock cartridges each having an additional latch bolt associated therewith. Cam rollers on the extension rods engage the latch bolts of the secondary cartridges for simultaneous and coordinated displacement of these latch bolts with the latch bolt of the main cartridge. The secondary latch bolts conveniently include offset bolt heads to ensure engagement with a strike plate, notwithstanding door bowing which may occur as a result of indoor-outdoor temperature differentials and/or the passage of time. Moreover, the bolt heads of the latch bolts are removably mounted onto a bolt base for reversible installation in accordance with the direction of door swinging movement. Similarly, drive linkages interconnecting the indoor and outdoor handles with the actuator drive bar are also adapted for interchangeable installation to accommodate the direction of door swinging movement.

In an alternative preferred form adapted for use with a sliding door, the main lock cartridge again includes the actuator drive bar with a cam roller engaged with a modified cam plate adapted to displace the drive bar up and down in response to rotation of a thumbturn. The actuator drive bar is connected in turn by the extension rods to a pair of secondary lock cartridges having headed latch pins for releasable locked engagement with keeper plates mounted on the adjacent door jamb. Displacement of the actuator drive bar and the associated extension rods is effective to displace the latch pins vertically and to draw the heads of the latch pins snugly against blind sides of the keeper plates for secure locking engagement therewith.

In either embodiment, the lock members of the door lock assembly can be adapted for locking engagement with strike or keeper plates on a fixed door jamb, or for locking engagement with an adjacent side edge of a second or semi-active door of a double door entry set. In the latter case, a header-sill lock assembly is provided with the second door and includes lock pins normally projecting into keeper plates at the door header and sill. An actuator button on the second door is engageable with the other or primary door in the closed condition for positively retaining the header-sill lock assembly in a locked condition. With this arrangement, opening of the second door is prevented unless the primary door is also in an open condition.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 6 is a perspective view of the main lock cartridge of FIG. 5, and depicting the main lock cartridge substantially in assembled form and adapted for interchangeable mounting of indoor and outdoor drive links;

FIG. 7 is a front elevational view of an indoor drive link for use in the main lock cartridge of FIG. 6;

FIG. 8 is a front elevational view of an outdoor drive link for use in the main lock cartridge of FIG. 6;

DETAILED DESCRIPTION OF THE PREFERRED EMBODIMENTS

Figure 1:
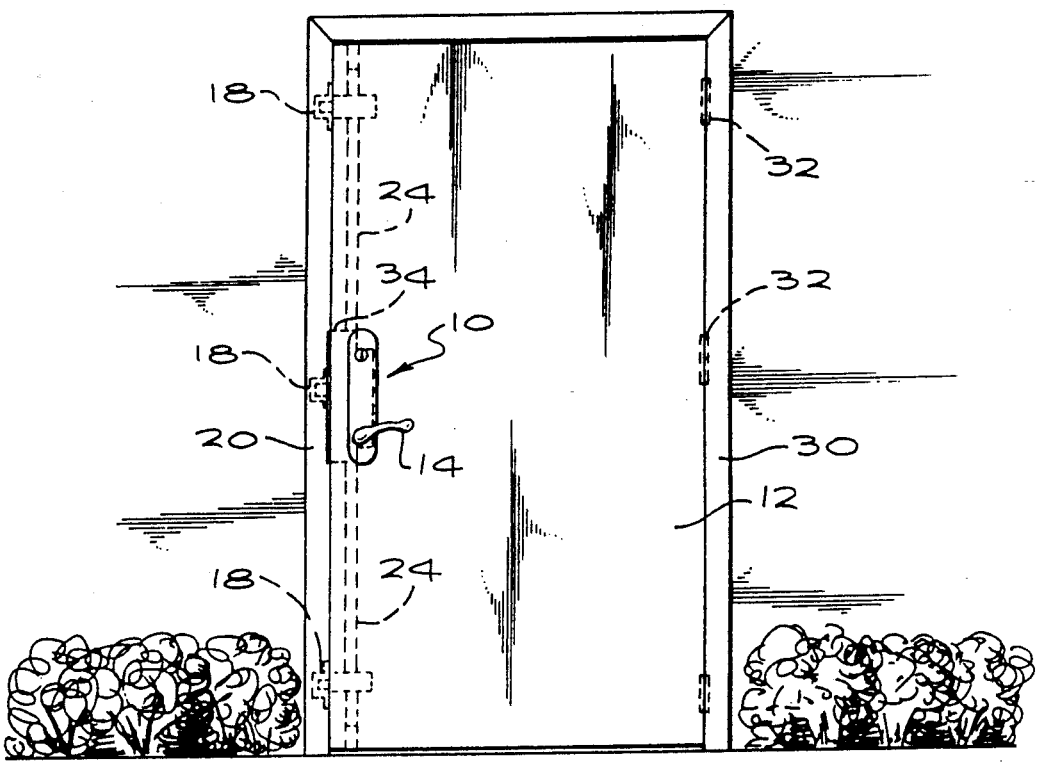
FIG. 1 is an outdoor side elevational view depicting a swinging door equipped with an improved multipoint door lock assembly embodying the novel features of the invention.

As shown in the exemplary drawings, an improved multipoint door lock assembly referred to generally in FIG. 1 by the reference numeral 10 is provided for safely and securely locking an entry door 12 to a residence or business establishment or the like. The multipoint door lock assembly 10 includes multiple lock members mounted at spaced positions along one side edge of the door 12, wherein the lock members are adapted for convenient and concurrent operation by means of a single hand-operated actuator. FIG. 1 illustrates the invention for use with a standard hinged or swinging door 12, with a hand-operated actuator lever or handle 14 for concurrently operating the multiple lock members in the form of spring-loaded latch bolts.

The improved multipoint door lock assembly 10 of the present invention provides for an increased level of security when the door is in a closed and locked condition. The multiple lock members are mounted in vertically spaced relation along a side edge of the door 12 for individual engagement with aligned strike sets 18 installed within the adjacent door jamb 20, as viewed in FIG. 1. The provision of multiple lock members provides redundant locking to correspondingly minimize risk of unauthorized entry.

Figure 29:
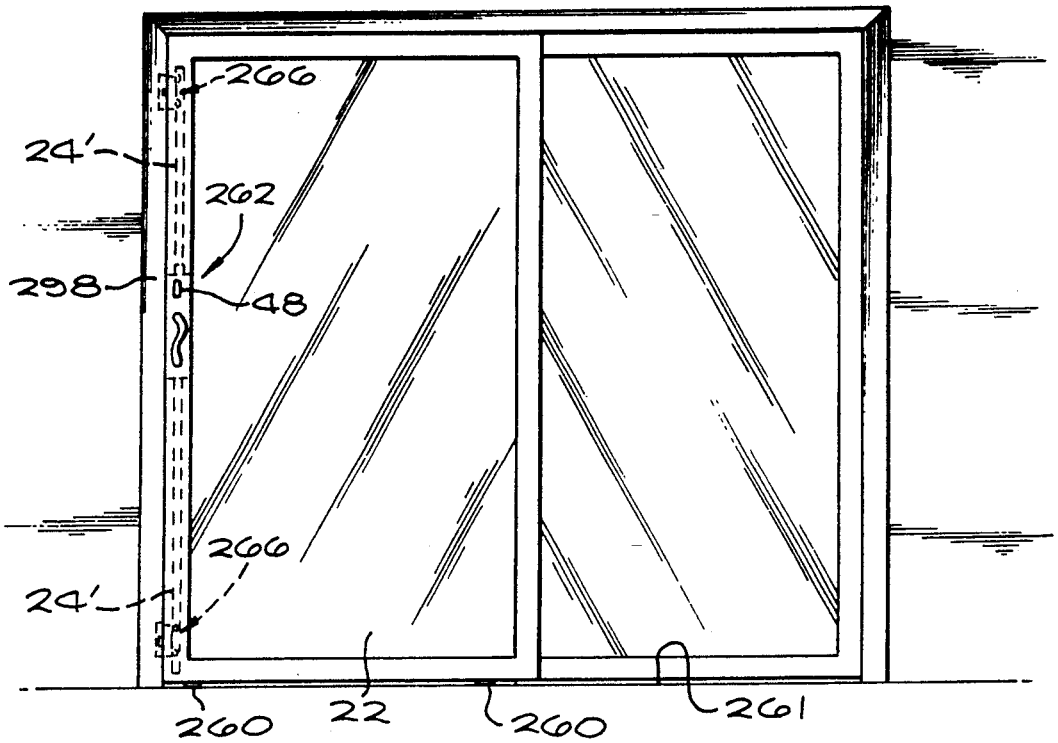
FIG. 29 is an outdoor side elevational view depicting an alternative embodiment of the multipoint door lock assembly adapted for use in combination with a slider door.

In accordance with general aspects of the invention, the multipoint door lock assembly is adapted with minimal modifications for use with a hinged or swinging entry door 12 as depicted in FIG. 1, or alternatively for use with a slider door 22 as shown in FIG. 29. In either case, the lock assembly comprises a main lock cartridge constructed in the preferred form from common housing and actuator drive components for rapid slide-in installation into the appropriate side edge or stile of the door. The main lock cartridge is mounted generally at a mid-height position and is associated with an appropriate actuator or actuators to accommodate the desired manipulation of the multiple lock members for purposes of locking and unlocking the door. In both embodiments, the main lock cartridge is connected by a pair of extension rods 24 mounted within the door side edge or stile for operating lock members near upper and lower edges of the door. In the swinging door configuration, the main lock cartridge additionally includes a third lock member.

Figure 24:
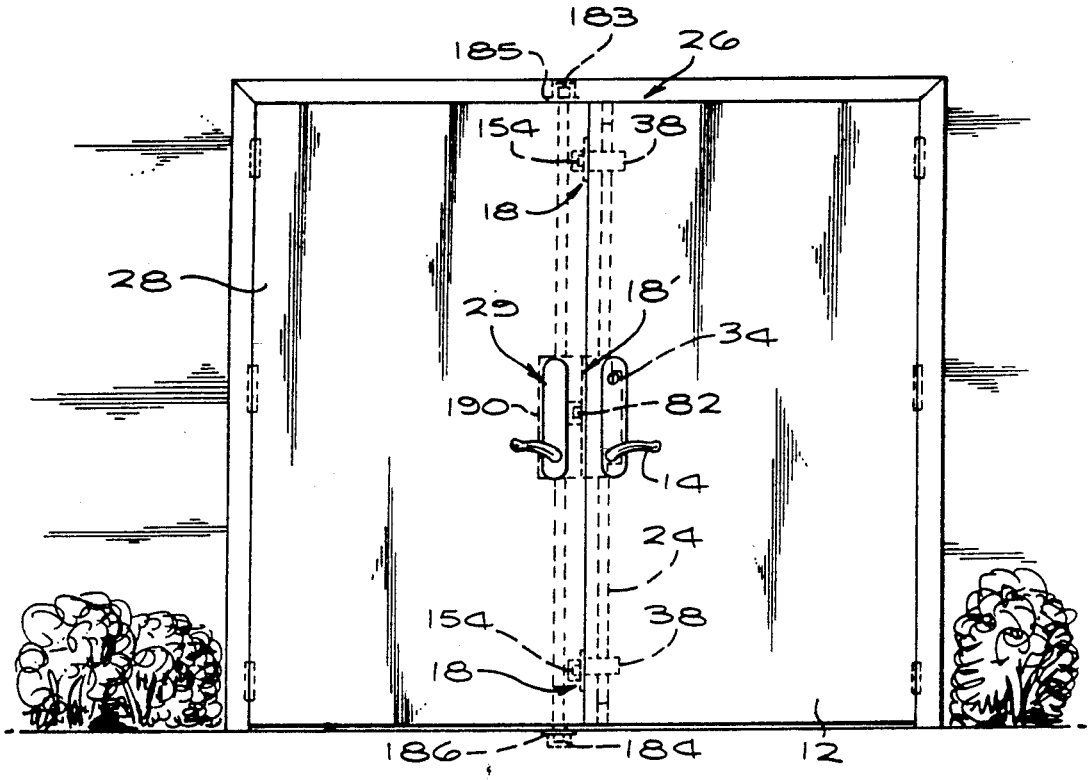
FIG. 24 is an outdoor side elevational view depicting a double door entry set including a swinging door having the improved multipoint door lock assembly of FIGS. 1-23, in combination with a second or semi-active swinging door equipped with a header-sill lock assembly for normally maintaining the second door in a closed and locked condition.
Figure 25:
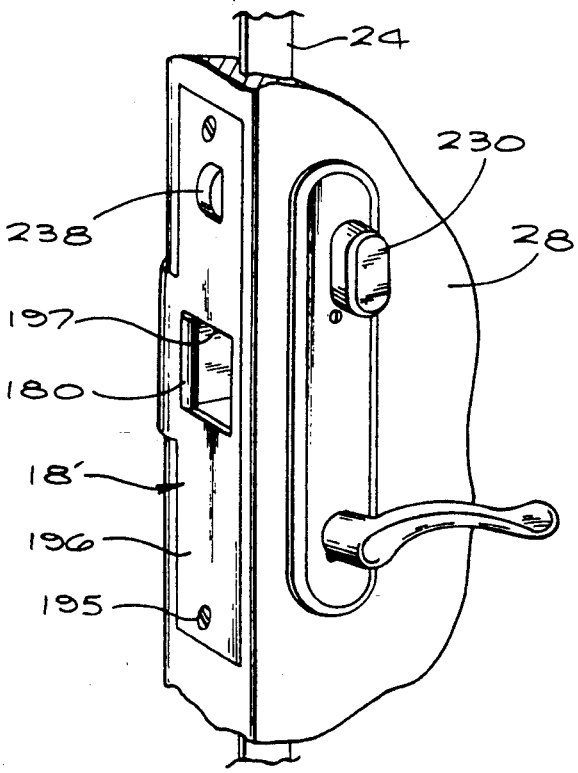
FIG. 25 is an enlarged fragmented perspective view illustrating a portion of the header-sill lock assembly at the indoor side of the second or semi-active door.

In accordance with further general aspects of the invention, the improved lock assembly may be used in a swinging or slider entry door of a double door entry set 26, as viewed by way of example in FIG. 24, wherein the multiple lock members are engageable with individual strike sets mounted at the side edge of an adjacent second or semi-active door 28. As viewed in FIG. 24, the semi-active door 28 include a header-sill lock assembly 29 for normally maintaining the semi-active door in a closed and securely locked condition. Importantly, when the semi-active door 28 is closed and locked, subsequent closure of the primary or active door effectively disables the header-sill lock assembly 29 to prevent unlocking of the semi-active door. Accordingly, the semi-active door 28 is positively retained in the closed and locked condition, unless and until the primary door is opened.

Figure 2:
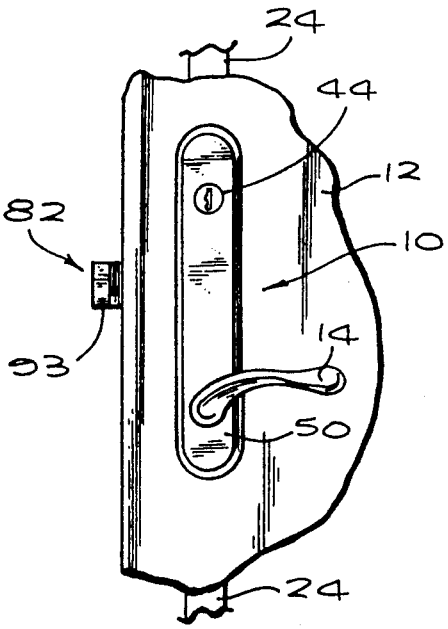
FIG. 2 is an enlarged fragmented outdoor side elevational view of a portion of the door and door lock assembly of FIG. 1.
Figure 3:
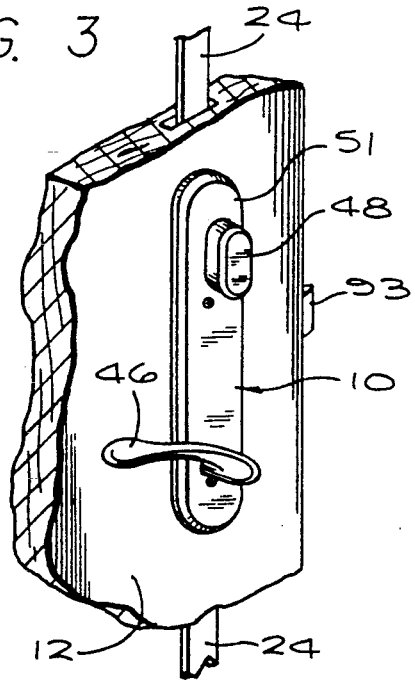
FIG. 3 is an enlarged fragmented perspective view illustrating a portion of the door and associated door lock assembly of FIG. 1, depicting the indoor side thereof.
Figure 4:
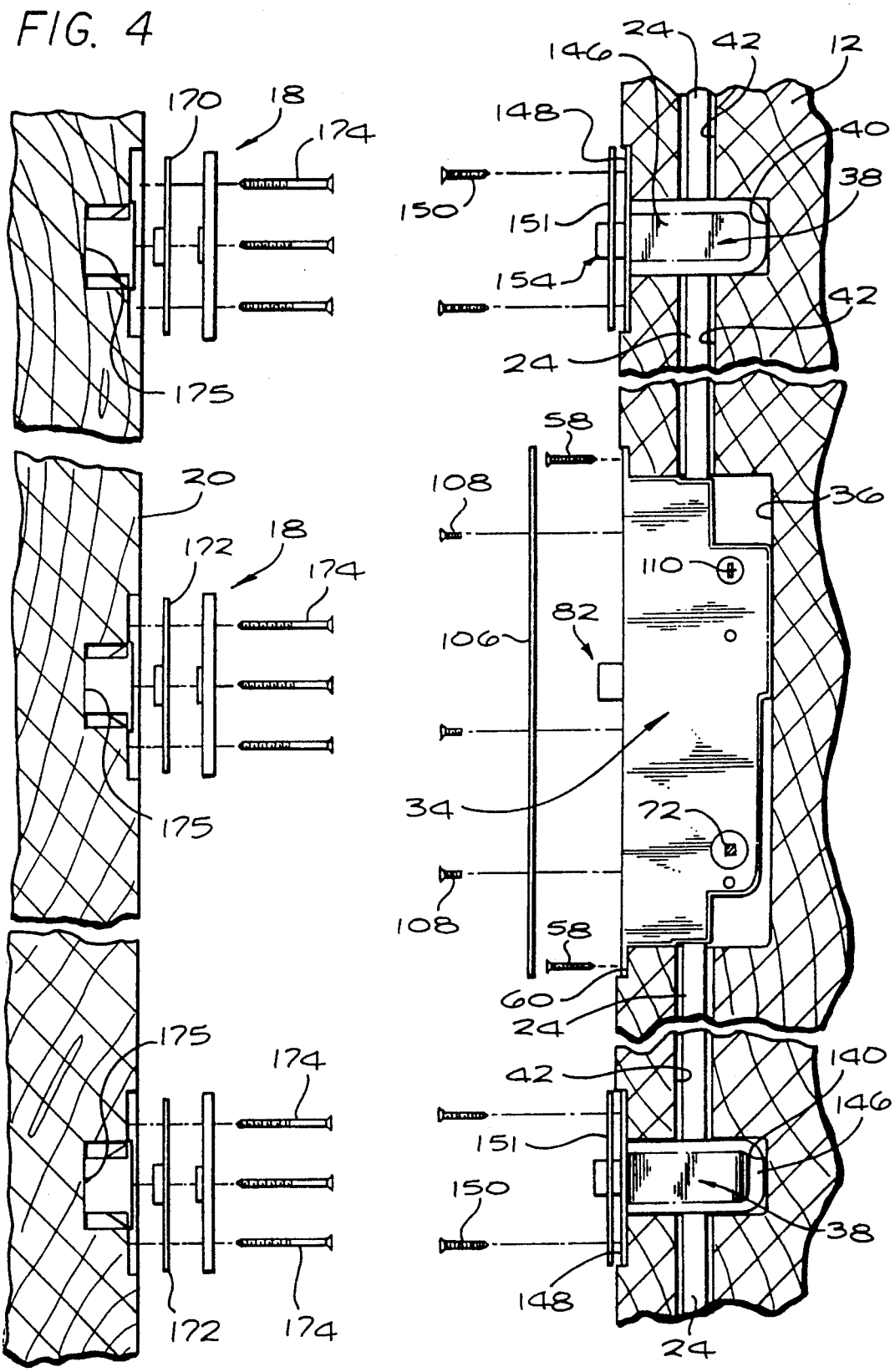
FIG. 4 is an exploded and fragmented elevational view illustrating the door lock assembly of FIGS. 1-3 mounted at one side edge of a swinging door, in combination with strike sets mounted on an adjacent door jamb.

FIGS. 1–4 illustrate the general construction and operation of the improved multipoint lock assembly 10 for use with the door 12 mounted on a frame 30 by hinges 32 for swinging movement between opened and closed positions. The lock assembly 10 is installed into the side edge of the door 12 opposite the hinges 32. The lock assembly 10 generally comprises the main lock cartridge 34 (FIG. 4) adapted for slide-fit reception into an open-sided chamber 36 formed in the door side edge, in combination with upper and lower secondary lock cartridges 38 mounted respectively within a corresponding pair of preformed open-sided pockets 40 in the same door side edge. The extension rods 24, which will be described in more detail, are mounted within vertically elongated channels 42 formed in the door to operatively interconnect the main lock cartridge 34 with the secondary lock cartridges 38. FIGS. 1 and 2 illustrate the manually operated actuator lever 14 on the outdoor side of the door 12, in combination with a keyed cylinder 44. A similar actuator lever or handle 46 is provided at the indoor side of the door 12 (FIG. 3), in association with a manually operable thumbturn 48. The actuator levers 14 and 46, as well as the keyed cylinder 44 and thumbturn 48, are operatively connected with the main lock cartridge 34 for controlling the positions of the multiple lock members, as will be described. Decorative escutcheons 50 and 51 are mounted respectively on the outdoor and indoor faces of the door 12 to conceal the mechanical connections between the main lock cartridge 34 and the actuator devices.

Figure 5:
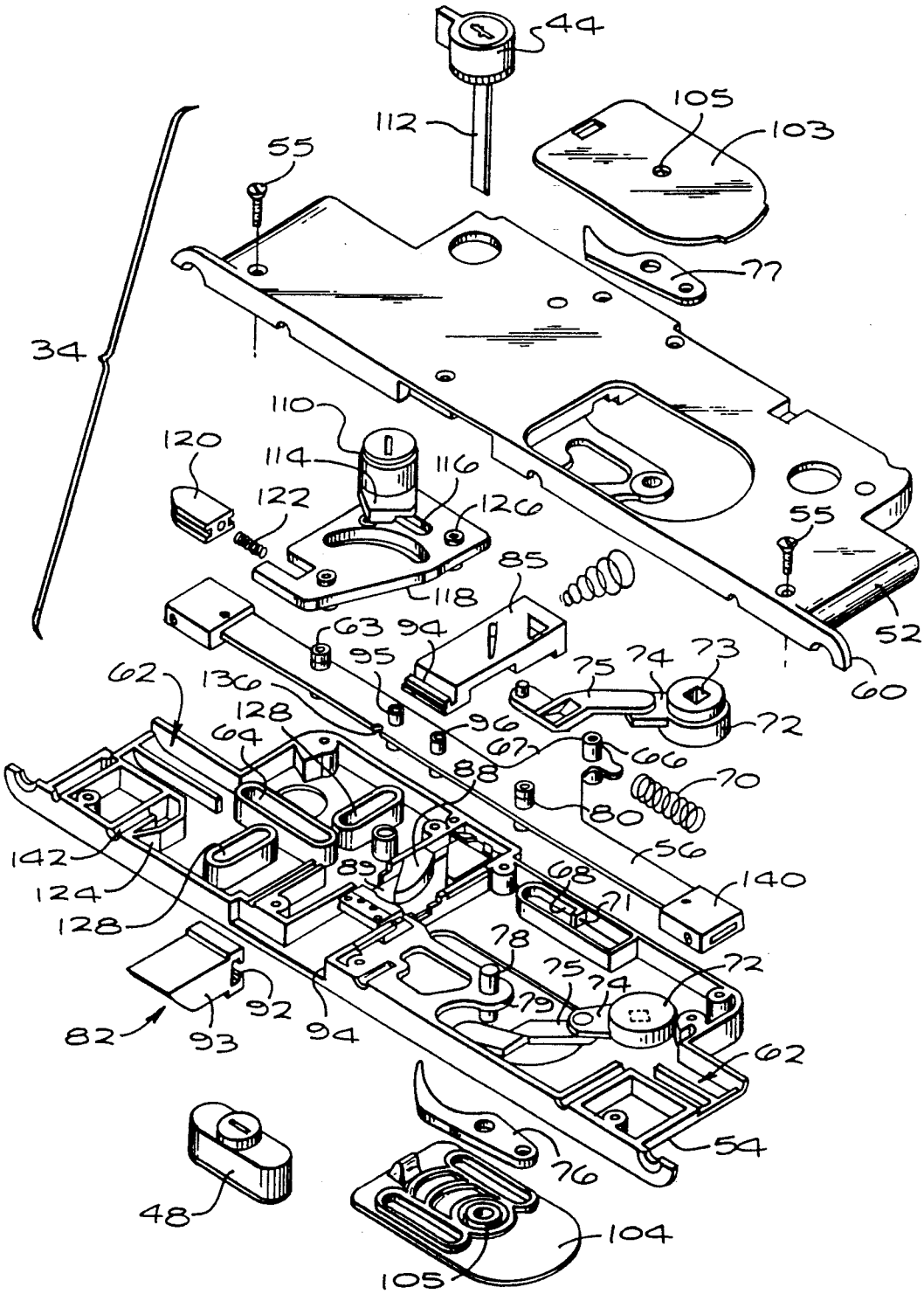
FIG. 5 is an exploded perspective view illustrating a main lock cartridge of the door lock assembly.

FIGS. 5 and 6 illustrate the main lock cartridge 34 in more detail, wherein the main cartridge is shown in an embodiment adapted for use with the swinging door 12. In general, the main lock cartridge comprises a pair of shell-shaped housing members 52 and 54, which may be conveniently and economically constructed from cast metal or molded plastic components or the like. These housing members 52 and 54 when assembled together by means of screws 55 or the like, encase the operating components of the lock assembly, particularly such as a main actuator drive bar 56. This drive bar 56 is supported for vertical up-and- down shifting movement in response to manual operation of the actuator levers 14 or 46, or in response to operation of the keyed cylinder 44 or thumbturn 48. Mechanical linkage components which interconnect these actuators with the drive bar 56 are also encased within the assembled housing members 52, 54. When fully assembled, essentially as viewed in FIG. 6, the main lock cartridge 34 is installed quickly and easily by simple slide-fit placement into the open-sided cavity 36 (FIG. 4) in the door side edge. Mounting screws 58 are conveniently fastened through end tabs 60 on the cartridge 34 to retain the main lock cartridge in a fixed position within the door side edge.

Figure 12:
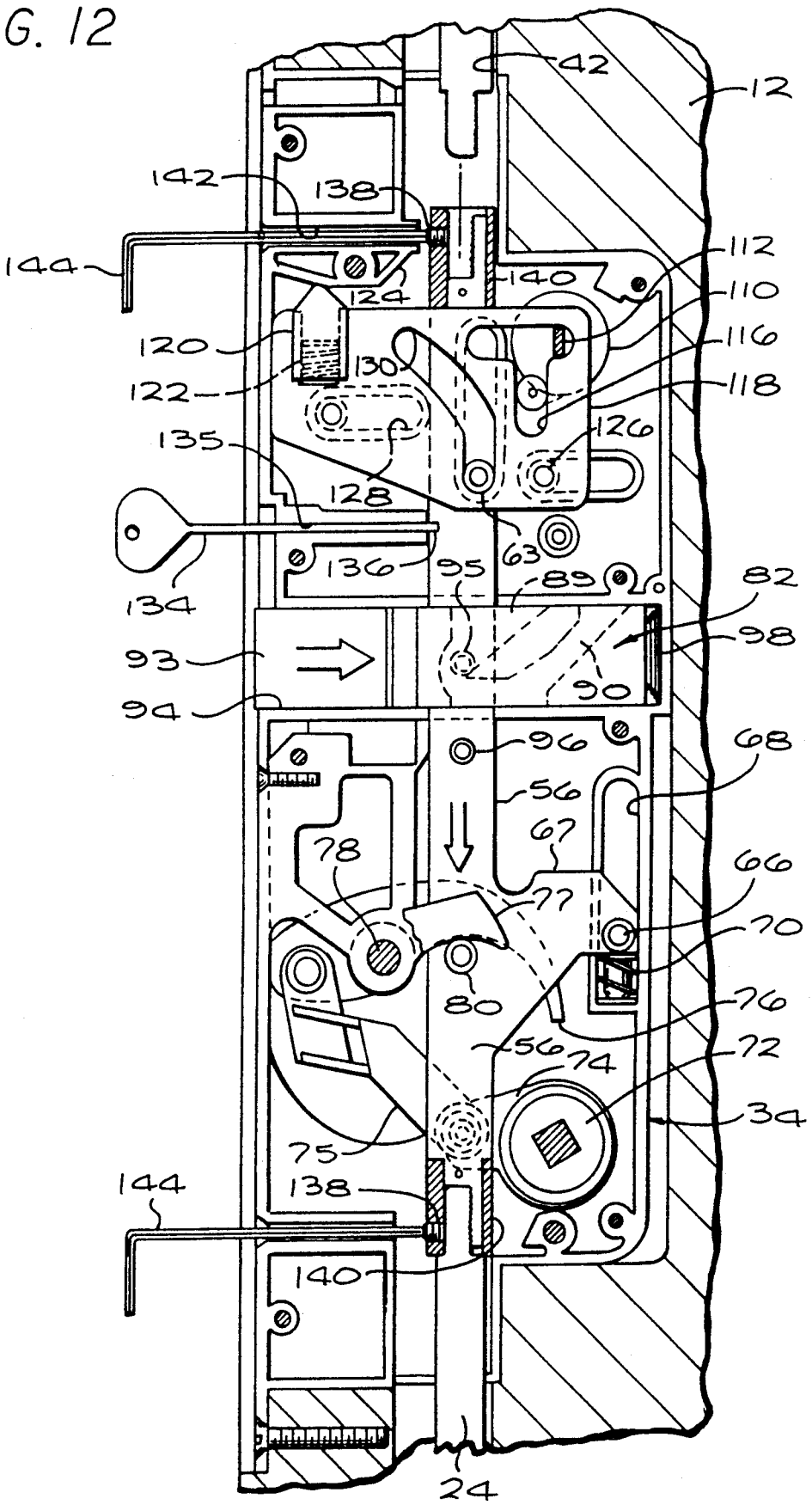
FIG. 12 is an enlarged fragmented vertical sectional view illustrating the main lock cartridge installed within one side edge of a swinging door, in combination with means for precision interconnection of the main lock cartridge with other components of the door lock assembly.

As shown generally in FIGS. 5 and 12, the actuator drive bar 56 comprises an elongated rigid bar having a size and shape for drop-in placement into a generally vertically extending slide track 62 defined by the assembled housing members 52, 54. An upper cam roller 63 on the drive bar 56 is received into vertically elongated cam tracks 64 formed within the housing members 52, 54 to constrain the drive bar 52 to a vertical path of motion of limited stroke length. In addition, a second cam roller 66 mounted on a side wing 67 of the guide bar 56 is received within additional vertically extending cam tracks 68 defined by the assembled housing member 52, 54. A compression spring 70 mounted within the cam tracks 68 reacts between a portion of the assembled housing members 52, 54 and the side wing 67 for applying an upward spring force to the drive bar 56 throughout a portion of the vertical drive bar stroke. More particularly, the geometry of the compression spring 70 and the cam tracks 64 and 68 apply the upward spring force to the drive bar 56 within a lower region of the drive bar stroke as viewed in FIG. 12. By contrast, when the drive bar 56 is positioned within an upper region of its vertical stroke, the spring 70 engages a stop 71 such that the spring is spaced from the side wing 67 such that no upward spring force is applied to the drive bar 56 (see FIG. 14), as will be described in more detail.

The outdoor and indoor actuator levers 14 and 46 are rotatably supported on the assembled housing members 52, 54 by means of appropriate bearing members 72. As shown best in FIG. 5, each bearing member 72 includes a noncircular bore 73 for rotatable driven reception of a mating noncircular drive shaft on the associated actuator lever. The bearing members 72 each include a laterally projecting ear lobe 74 connected pivotally to a drive link 75, which is pivotally connected in turn to an associated inner or outer crank link 76 or 77. Both crank links 76 and 77 are pivotally supported by a pin 78 on the cartridge housing members 52, 54 for back-and-forth swinging movement about the axis of the pin 78, in response to manual rotation of the associated lever handle 14 or 46. Both crank links 76 and 77 define a free end in the form of elongated finger positioned to engage a cam roller 80 on the actuator drive bar 56. That is, when the actuator lever 14 or 46 is rotated, the appropriate crank link 76 or 77 is pivotally displaced for purposes of normally engaging the cam roller 80, resulting in downward displacement of the actuator drive bar 56 along the cam tracks 64 and 68, and against the upward biasing force applied by the compression spring 70. Importantly, for some operating conditions as will be described in more detail, the free end of the inner crank link 76 is longer than the free end of the outer crank link 77. Moreover, drive linkages associated with the indoor and outdoor crank links 76 and 77 are mechanically independent, such that rotation of the outdoor actuator lever 14 is effective to displace only the outdoor crank link 77, and vice versa.

Figure 9:
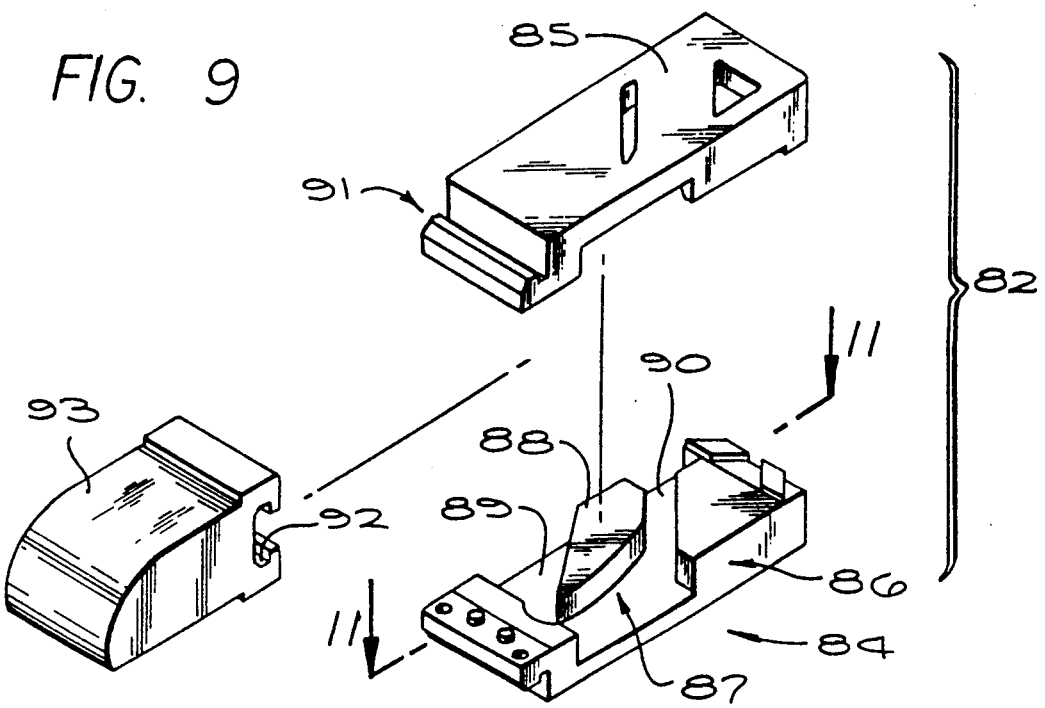
FIG. 9 is an exploded perspective view illustrating a latch bolt for use in the invention.
Figure 10:
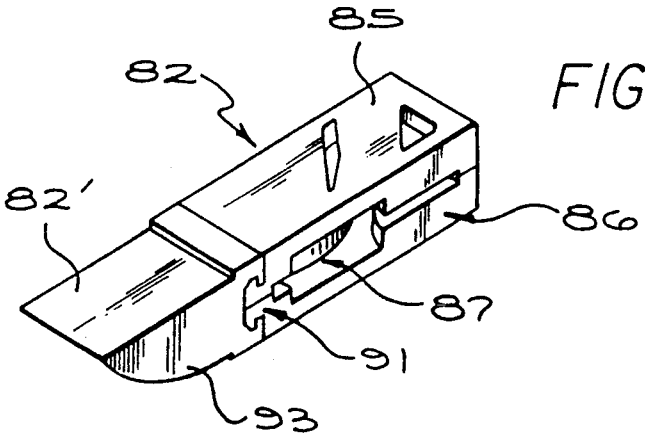
FIG. 10 is a perspective view depicting the latch bolt of FIG. 9.
Figure 11:
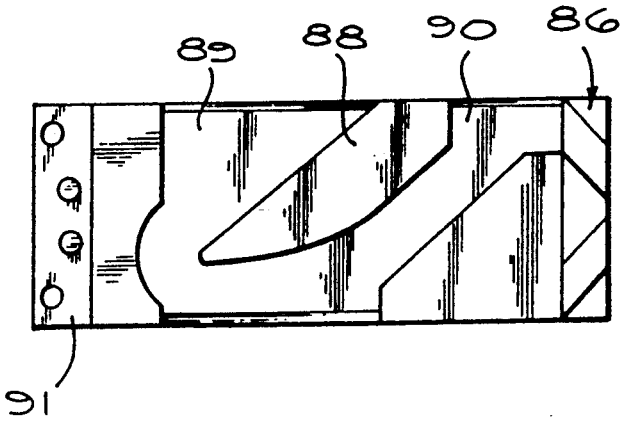
FIG. 11 is an enlarged plan view illustrating construction details of a portion of the latch bolt, taken generally on the line 11—11 of FIG. 9.

Displacement of the actuator drive bar 56 in response to rotation of the handle levers 14 or 46 operates a latch bolt 82 provided as a part of the main lock cartridge 34. More particularly, as shown in FIGS. 9–11, the latch bolt 82 comprises a bolt base 84 consisting of an assembled mated pair of slide blocks 85 and 86 defining interlocking pins and recesses, and/or interlocking dovetail keys and slots. When assembled, the slide blocks 85 and 86 have a relatively high resistance to shear forces, yet define a vertically open drive port 87 for through passage of the actuator drive bar 56. A bolt cam 88 is also provided on each of the slide blocks 85 and 86 at a position within the slot 87. As shown best in FIG. 11, the bolt cam 88 cooperates with other portions of the associated slide blocks to subdivide the drive port 87 into a pair of angularly oriented, generally parallel cam slots 89 and 90. These cam slots 89 and 90 are formed to extend forwardly and downwardly within the latch bolt.

Figure 13:
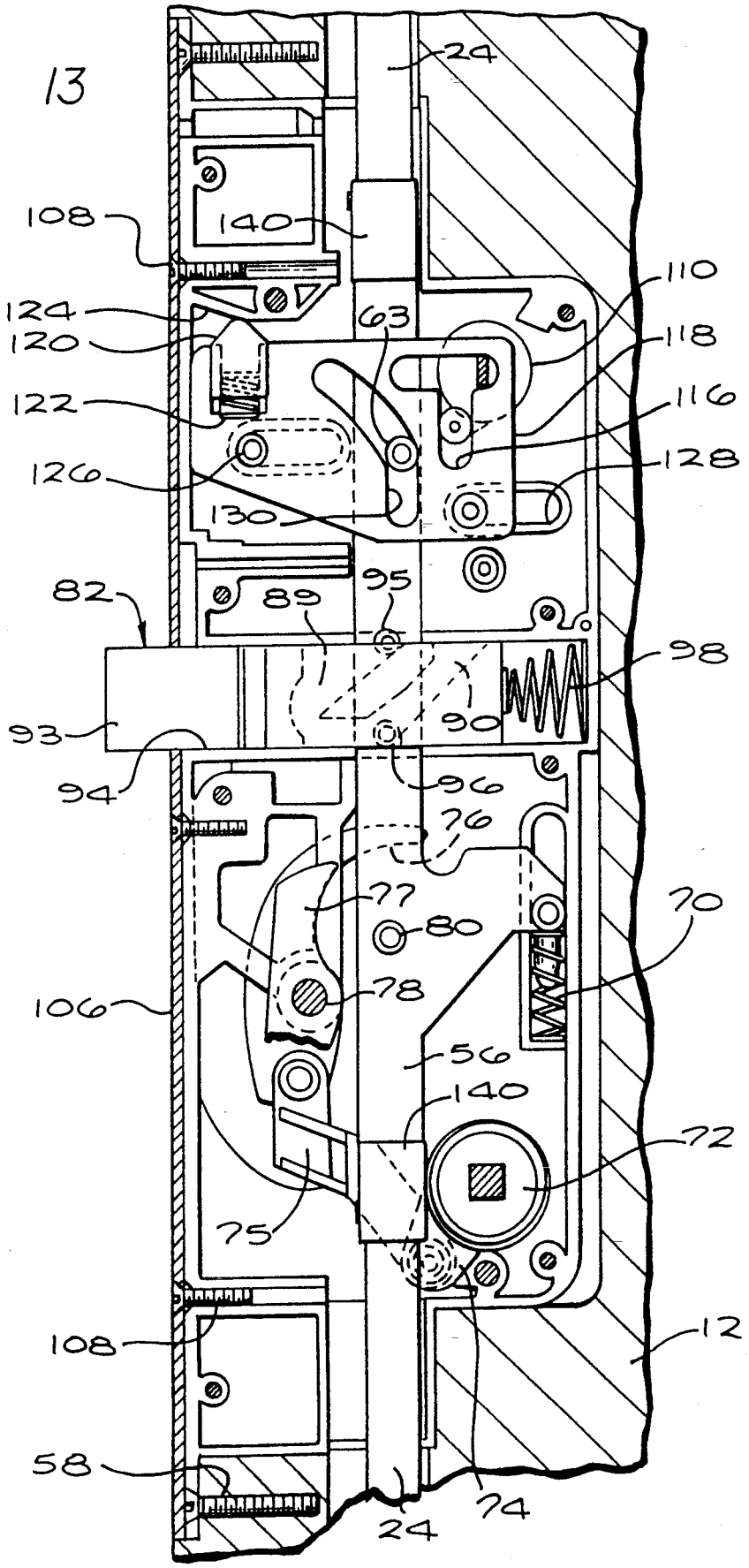
FIG. 13 is a fragmented vertical sectional view similar to FIG. 12 depicting the main lock cartridge with the latch bolt in a first or normal latched position.
Figure 14:
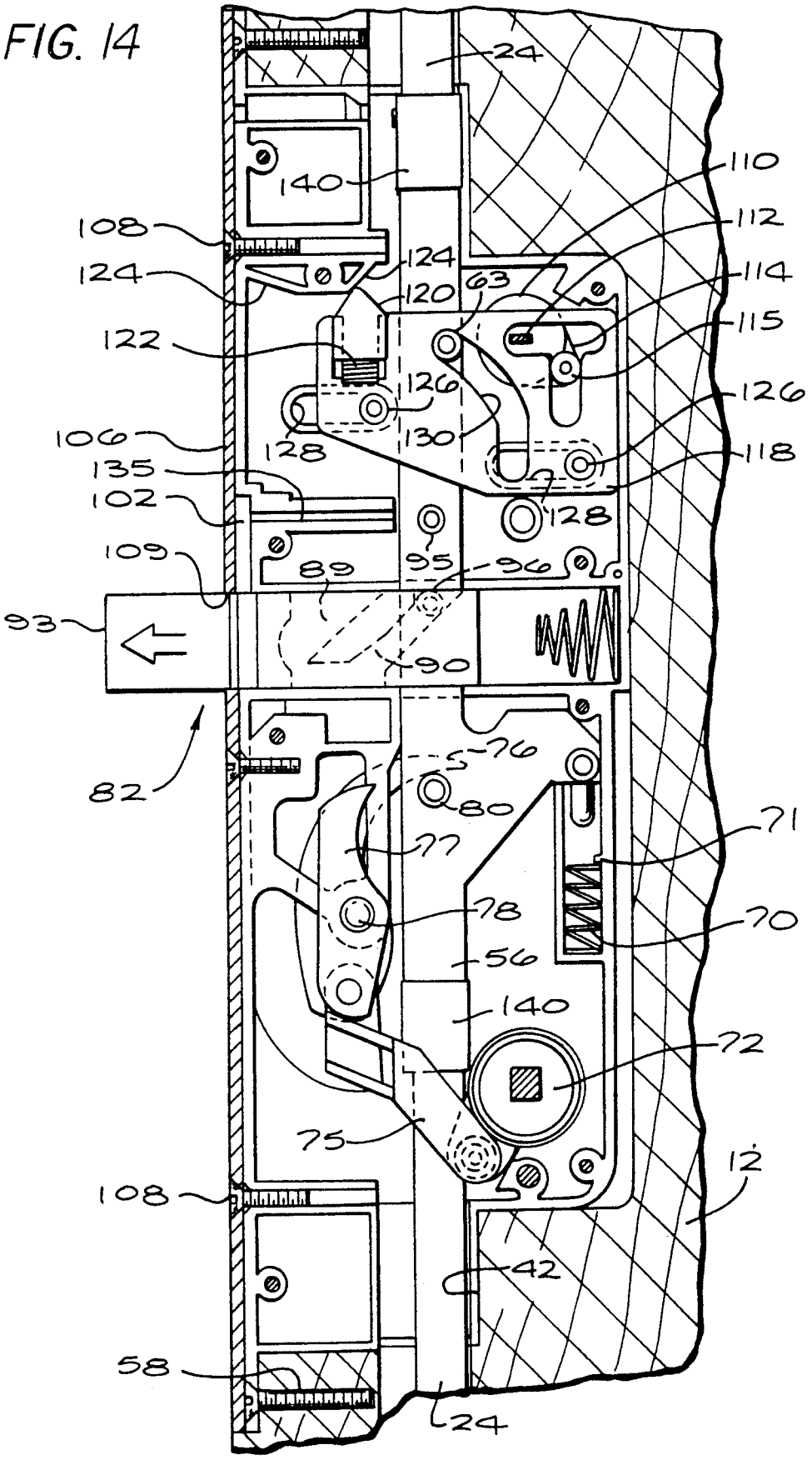
FIG. 14 is an enlarged fragmented sectional view similar to FIGS. 12 and 13, but depicting the latch bolt in a second, further extended deadbolt position.

In addition, a nose end of the assembled bolt base 84 defines a dovetail key 91 for slide-fit mounting into a vertically oriented dovetail slot 92 on a bolt head 93. As shown in FIGS. 5 and 12, the assembled latch bolt 82 is adapted for slide-fit mounting into an open-ended, generally horizontally extending bolt track 94 defined by the assembled housing members 52, 54 in a position to intersect the slide track 62 and the actuator drive bar 56 mounted therein. The bolt drive port 87 defined by the slide blocks 85 and 86 accommodates through passage of the drive bar 56, with a pair of cam rollers 95 and 96 on the drive bar 56 disposed in operative relation with the bolt cam slots 89 and 90, respectively. Accordingly, downward shifting movement of the drive bar 56 within the assembled housing members 52, 54 is effective to advance and retract the latch bolt 82 (FIG. 12). A bolt spring 98 preferably of a conical profile reacts between a blind end of the bolt track 94 and the bolt base 84 for normally urging the bolt head 93 toward a first or normal latched position protruding laterally outwardly beyond the door side edge, as viewed in FIG. 13. Thus, appropriate rotation of the actuator levers 14 or 46 is effective to shift the drive bar 56 downwardly within the main lock cartridge 34, thus engaging the upper cam roller 95 with the bolt cam 88 within the angled bolt cam slot 89 of the latch bolt to retract the bolt head 93 to the position shown in FIG. 12. Conversely, upward shifting of the drive bar within the housing members engages the lower cam roller 96 with the bolt cam 88 within the second bolt cam slot 90 to shift the latch bolt beyond the latched position of FIG. 12 to a further extended, deadbolt position, as shown in FIG. 14, and as will be described in more detail.

That is, downward displacement of the drive bar 56 upon rotation of either lever handle 14 or 46 engages the upper cam roller 95 with an angled upper cam surface on the bolt cam 88. This engagement displaces the latch bolt 82 in a retraction direction, against the bolt spring 98, to move the latch bolt 82 from the latched position of FIG. 13 to the retracted position of FIG. 12. The downward displacement of the drive bar 56 is accompanied by compression of the drive bar spring 70. Subsequent release of the lever handle enables the latch bolt 82 to return automatically to the extended normal latched position in response to the combined spring forces applied by the compression springs 70 and 98. In the normal latched position, the lever handles 14 and 46 are normally retained in a horizontal orientation by means of a centering spring (not shown) which may be constructed in accordance with the lever handle mount arrangement depicted in U.S. Pat. No. 4,671,089, which is incorporated by reference herein.

In accordance with one aspect of the invention, the bolt head 93 and the crank links 76, and 77 are designed for reversible mounting to accommodate rapid adaptation of the lock assembly for a right-hand or left-hand swinging door installation. More particularly, a side face 100 of the assembled housing members 52, 54 (FIG. 6) is interrupted by the bolt track 94 from which the bolt head 93 projects. In a normal position for latched closure of the door (FIG. 13), the dovetail joint between the bolt head 93 and the bolt base 84 is disposed within the bolt track sufficiently to prevent disassembly of bolt components. However, when reversed mounting of the bolt head 93 is desired, the latch bolt can be further extended to the deadbolt position shown in FIG. 14, whereat the dovetail joint is aligned with a recessed track 102 (FIGS. 6 and 14) formed in the side face 10 of the assembled housing members 52, 54. In this further extended position, the bolt head 93 can be slidably removed from the dovetail key 91 and then reversibly oriented for reinstallation onto the dovetail key.

In a similar manner, snap-mounted access plates 103 and 104 are provided respectively on the housing members 52, 54 in positions overlying the pivot pin 78 for supporting the crank links 76 and 77. These access plates 103 and 104 can be disassembled from the housing members to permit access to and appropriate removal of the crank links 76, 77 for tailoring the lock cartridge for a right-hand or left-hand swinging door installation. In each case, the shorter crank link 77 is installed at the outdoor side of the main lock cartridge 34. As shown in FIG. 5, the access plates each include a bearing portion 105 for receiving the end of the pivot pin 78, such that the removably mounted crank links 76, 77 are pivotally installed between a central flange 79 on the pivot pin and the associated access plate.

In operation, the latch bolt 82 is shifted quickly and easily to the further extended or deadbolt position viewed in FIG. 14 by appropriate operation of the keyed cylinder 44 or thumbturn 48, whereby the latch bolt 82 serves the dual function of a deadbolt. In this regard, subsequent to orienting the bolt head 93 on the bolt base 84, a face plate 106 is mounted over the side face 100 of the assembled housing members 52, 54, by means of screws 108 (FIGS. 13–14), wherein the face plate 106 has a port 109 formed therein for slide-fit bolt head passage. However, the face plate 106 otherwise covers the recessed track 102 and thus blocks bolt head disassembly from the bolt base 84.

Advancement of the latch bolt 82 to the deadbolt position of FIG. 14 is achieved by means of a cylindrical actuator 110 which is rotatably supported between the assembled housing members 52, 54, and adapted to receive a strip-shaped tail piece 112 extending between the keyed cylinder 44 and the thumbturn 48. In this regard, the keyed cylinder 44 and thumbturn 48 are adapted for interchangeable mounting onto the tail piece 112 at the appropriate outdoor and indoor sides, respectively, of the door 12.

The cylindrical actuator 110 includes a side lobe 114 with a cam roller 115 projecting into a T-shaped drive track 116 of a cam plate 118. Rotation of the keyed cylinder 44 or the thumbturn 48 from the appropriate outdoor or indoor side of the door is effective to shift the cam plate 118 back-and-forth between two set positions, as viewed in FIGS. 13 and 14. A detent pin 120 biased by a spring 122 engages a ramped surface 124 within the assembled housing members 52, 54 for springably retaining the cam plate 118 in a selected one of the two different positions. Guide rollers 126 on the cam plate 118 may be received within guide tracks 128 on the assembled housing members to ensure smooth back-and-forth shifting movement of the cam plate 118.

The cam plate 118 additionally includes a follower track 130 adapted to receive the upper most cam roller 63 on the actuator drive bar 56. The follower track 130 is defined by a curved or arcuate upper segment which joins with a substantially linear vertically extending lower segment. When the cam plate 118 is in a disengaged or nondeadbolt position, the cam roller 63 is disposed within the vertical lower segment of the follower track 130, thereby permitting substantially unimpeded vertical shifting of the drive bar 56 between a first position with the latch bolt normally extended to the latched position (FIG. 13) and a second position with the latch bolt retracted into the main lock cartridge to permit door opening (FIG. 12). Shifting of the cam plate 118 to the second or extended deadbolt position causes the cam roller 63 to ride upwardly within the curved upper segment of the follower track 130 (FIG. 14). This correspondingly lifts the actuator drive bar 56 in a manner engaging the cam roller 96 within the lower angled cam slot 90 of the latch bolt 82. As previously described, this engagement of the cam roller 96 with the latch bolt effectively advances the latch bolt to the further extended deadbolt position. Return displacement of the cam plate 118 to a nondeadbolt position engages the cam roller 96 with an aft side of the bolt cam slot 90 to retract the latch bolt to the normal latched position, and thereby permit downward displacement of the drive bar 56, and resumed normal latch operation.

In accordance with a further aspect of the invention, the length of the inner drive crank link 76 associated with the indoor lever handle 46 has a sufficient length to provide panic release and opening of the door when the latch bolt 82 is in the deadbolt position. More particularly, the longer free end of the inner crank link 76 (FIG. 14) is sufficient to engage the cam roller 80 when the drive bar 56 is raised to the deadbolt position. Rotation of the indoor lever handle 46 will thus result in displacing the drive bar 56 downwardly to open the door, with corresponding return movement of the cam plate 118 to the nondeadbolt position. By contrast, however, the shorter length of the outer crank link 77 is insufficient to engage the cam roller 80 when the latch bolt 82 is advanced to the deadbolt position. Accordingly, in the deadbolt position, rotation of the outdoor lever handle 14 is ineffective to displace the actuator drive bar 56 downwardly, such that use of the outdoor lever to open the door is positively precluded.

FIG. 12 illustrates calibrated connection of the actuator drive bar 56 to the upper and lower extension rods 24 for purposes of operating additional latch bolts associated with the secondary lock cartridges 38. In particular, with the main lock cartridge 34 installed into the side edge of the door, but prior to installation of the face plate 106, as alignment key 134 is passed through a port 135 formed at the recess 102 by the assembled housing members 52, 54. A tip end of the key 134 is engaged into a shallow notch 136 formed in the drive bar 56 for retaining the drive bar at a preset location. As viewed in FIG. 12, the illustrative preset location corresponds with the latch bolt 82 in a retracted position. However, it will be understood that the alignment notch 136 can be formed in the drive bar 56 to receive the alignment key in any other latch bolt position, such as the normal latched or the deadbolt positions as viewed in FIGS. 13 and 14.

With the drive bar 56 retained in the desired preset position by the alignment key 134, set screws 138 mounted on a pair of connector cuffs 140 at opposite ends of the drive bar 56 are positioned in substantial alignment with screw ports 142 which may conveniently comprise the same threaded bores adapted for subsequent reception of the screws 108 used to mount the face plate 106. Prior to such mounting of the face plate 106, Allen wrenches 144 can be passed through the screw ports 142 for engaging the set screws 138. In this regard, the set screws 138 are positioned to retain the ends of the extension rods 24 in bearing engagement with the drive bar 56, wherein this engagement is shown in the form of overlapping edges of mating serrated configuration disposed within the connection cuffs 140. Accordingly, when the ends of the extension rods 24 are inserted into the connector cuffs 140, the Allen wrenches 144 are used to tighten the set screws 138 and thereby securely interconnect the actuator drive bar 56 with the extension rods 24. The use of overlapping serrated teeth on the ends of the drive bar 56 and the associated extension rods 24 provides an easily and positively locked mechanical connection having high tensile strength capacity.

Installation of the extension rods 24 occurs by inserting the rods into the formed channel 42 at the top and bottom of the door 12. The rods are passed through the secondary lock cartridges 38, which will be described in more detail, and further through the channels 42 for set screw connection with the actuator drive bar 56.

FIGS. 15–18 illustrate one of the secondary lock cartridges 38 in operative engagement with the associated extension rod 24. In this regard, each secondary lock cartridge 38 comprises a compact housing 146 formed from an assembled pair of molded or cast housing members all in a manner similar to the assembled housing members 52, 54 of the main lock cartridge 34. The assembled cartridge housing 146 is sized and shaped for relatively easy slide-fit reception into the associated pocket 40 in the side edge of the door 12. A pair of outwardly projecting end tabs 148 are provided to facilitate secure cartridge attachment to the door 12 by means of a pair of mounting screws 150 or the like. A separate decorative face plate 151 (FIG. 4) may be mounted onto the outboard edge of the secondary lock cartridge by means of the screws 150, or by the use of separate mounting screws fastened into the cartridge housing 146 in a manner similar to that previously described with respect to the face plate 106 for the main lock cartridge.

Each secondary lock cartridge 38 defines an open-ended bolt track 152 for sliding reception of a latch bolt 154 having a construction generally similar to the latch bolt 82 described with respect to the main lock cartridge 34. More particularly, the illustrative latch bolt 154 includes a bolt base 155 formed from an assembled pair of slide blocks which may be identical to the slide blocks 85 and 86, as previously described, and when assembled, define the angularly oriented pair of cam slots 89 and 90. A bolt head 160 is removably mounted onto a nose end of the base 155 by means of a dovetail connection as previously described with respect to the latch bolt 82. A bolt spring 98 formed preferably with a conical geometry reacts between a blind end of the bolt track 152 and the bolt base 155 for urging the latch bolt 154 toward a normal latching position (FIG. 17) with the bolt head 160 protruding from the side edge of the door. Reversible mounting of the bolts 154 into the associated bolt track 152 accommodates a left-hand or right-hand door installation.

A pair of cam rollers 163 and 164 are carried by the extension rod 24 for engaging the latch bolt 154 respectively within the cam slots 89 and 90. More particularly, when the extension rod 24 is displaced downwardly from the normal position upon rotation of the indoor or outdoor lever handle at the main lock cartridge, the upper cam roller 163 rides within the upper cam slot 89 to engage the bolt cam 88 and displace the latch bolt 154 to a normal retracted position, as viewed in FIG. 16. Release of the appropriate indoor or outdoor lever handles enables spring-loaded return of the latch bolt 154 to the normal latched position, as viewed in FIG. 17. When the extension rod 24 is lifted further within the channel 42 upon operation of the deadbolt mechanism on the main lock cartridge, the cam roller 164 rides upwardly within the lower cam slot 90 to engage the bolt cam 88 and advance the latch bolt 154 to the deadbolt position, as viewed in FIG. 18.

Figure 18:
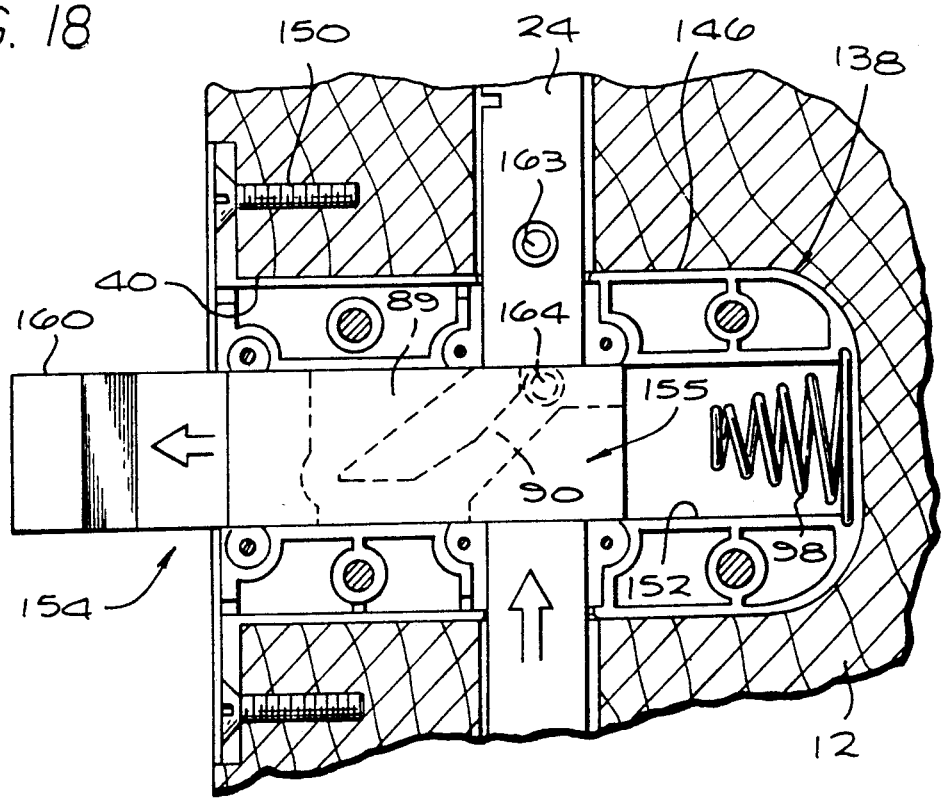
FIG. 18 is a fragmented sectional view similar to FIGS. 15-17, and depicting the latch bolt of the secondary lock cartridge in a second, further extended deadbolt position.

Accordingly, by way of summary of operation, the interconnection of the upper and lower extension rods 24 with the actuator drive bar 56 on the main lock cartridge 34 provides for operation of the upper and lower latch bolts 154 concurrently with the latch bolt 82 on the main lock cartridge. All three latch bolts are normally positioned in a spring-loaded projecting configuration for normal latched closure of the door 12 as viewed in FIGS. 13 and 17. Rotational displacement of the actuator levers associated with the main lock cartridge 34 is effective to concurrently retract all three latch bolts (FIGS. 12 and 16), and thereby permit opening of the door. Similarly, operation of the deadbolt mechanism on the main lock cartridge 34 simultaneously shifts all three latch bolts to the further extended deadbolt position for safe and secure deadbolt locking of the door (FIGS. 14 and 18). As previously described, the latch bolts can be retracted from the deadbolt position by operating the deadbolt mechanisms, or alternatively by rotating the indoor lever handle 46.

Figure 15:
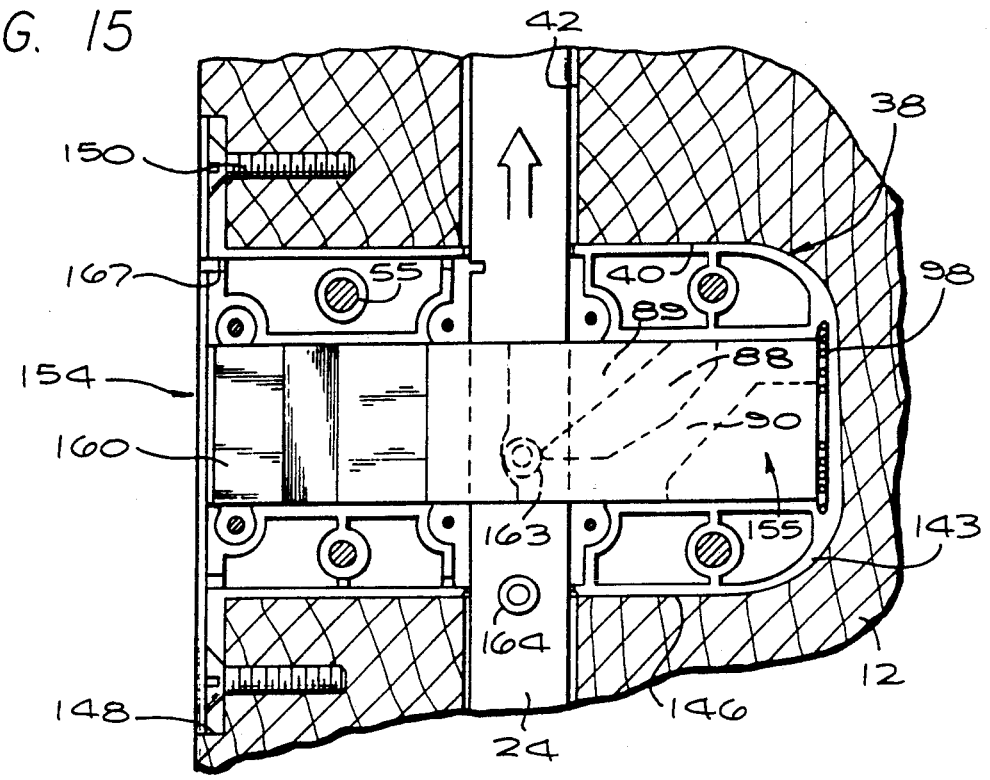
FIG. 15 is an enlarged fragmented vertical sectional view illustrating one of a pair of secondary lock cartridges and installation thereof into one side edge of the swinging door.
Figure 16:
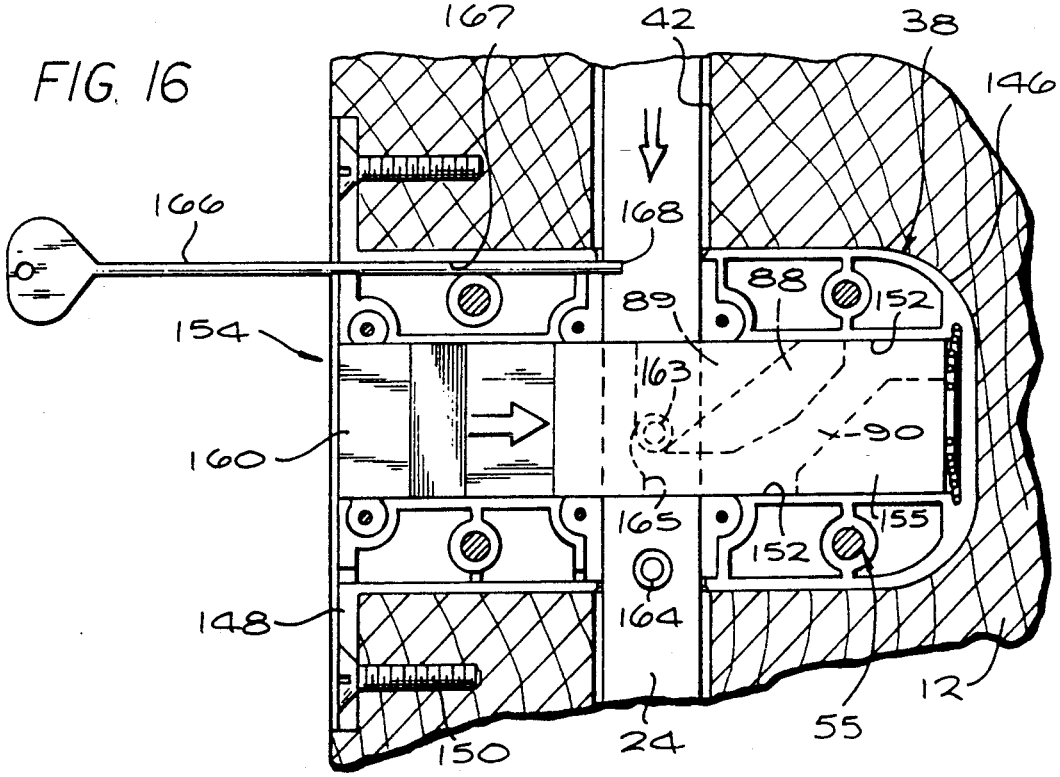
FIG. 16 is a fragmented sectional view similar to FIG. 15, and illustrating precision interconnection between the secondary lock cartridge and the main lock cartridge.
Figure 17:
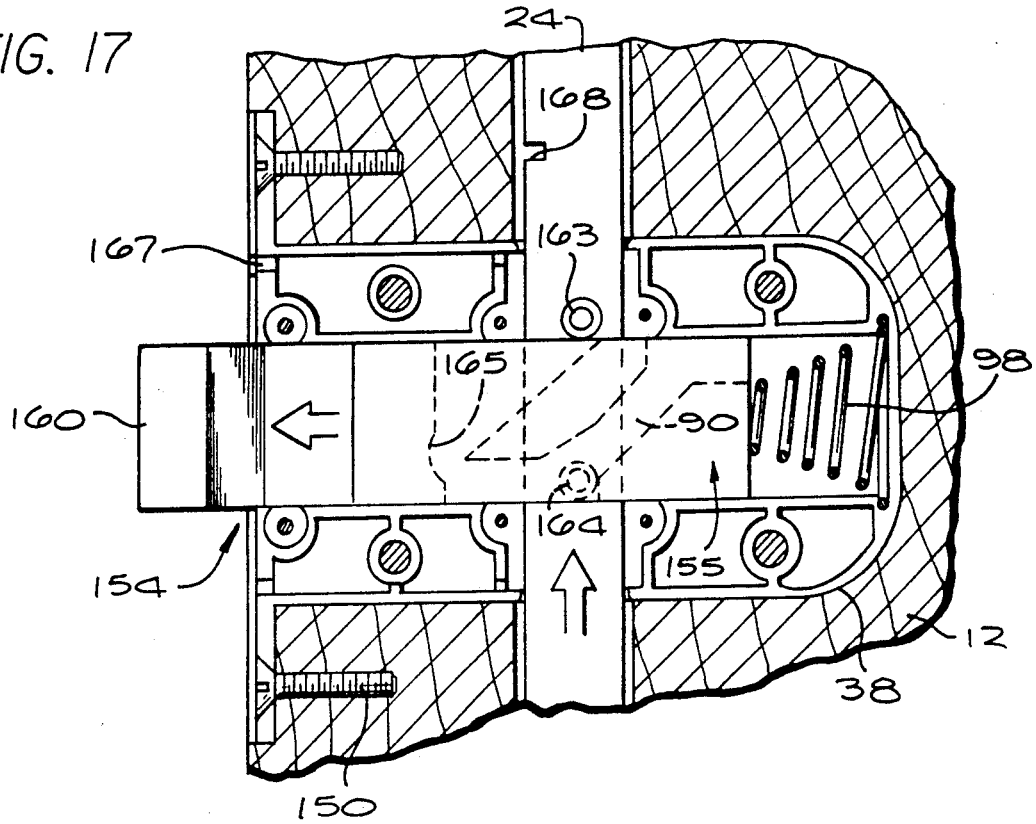
FIG. 17 is a fragmented sectional view similar to FIGS. 15 and 16, and depicting a latch bolt of the secondary lock cartridge in a first or normal latched position.

FIGS. 15 and 16 depict installation of the secondary lock cartridge 38 into the side edge of the door, in interconnected relation with the associated extension rod 24. More particularly, the cartridge 38 is seated within the associated pocket 40 in the door with the latch bolt 154 installed therein. In the case of both secondary lock cartridges 38 disposed respectively above and below the main cartridge 34, the associated extension rod 24 is passed through the formed channel 42 and the associated vertically open slot defined by the assembled slide members of the bolt base 155, for purposes of connecting the end of the extension rod 24 and with the actuator drive bar 56, as viewed in FIG. 12. For the upper secondary lock cartridge 38, the position of the latch bolt 154 is adjusted to permit passage of the lower cam roller 164 on the extension rod 24 through one of the bolt cam slots 89 and 90. For the lower cartridge 38 as shown in FIG. 15, the latch bolt 154 is manually retracted to a position slightly beyond the normally fully retracted position, for substantially full compression of the conical bolt spring 98. The extension rod 24 is then fitted upwardly through the bolt base, with a contoured recess 165 at a forward edge of the bolt cam slot 89 permitting upward passage of the upper cam roller 163. An alignment key 166 is then passed through a port 167 in the cartridge housing 146 for reception into a notch 168 in the extension rod 24 (FIG. 16) to retain the bolt in the retracted position for proper extension rod alignment and interconnection with the drive bar 56 (FIG. 12) to achieve the desired concurrent actuation of the three latch bolts. Alternately, as previously described, the alignment notch 168 for the secondary lock cartridges may be located to receive the alignment key 166 in other bolt positions, in accordance with the alignment key positions of the latch bolt or the main lock cartridge.

Figure 19:
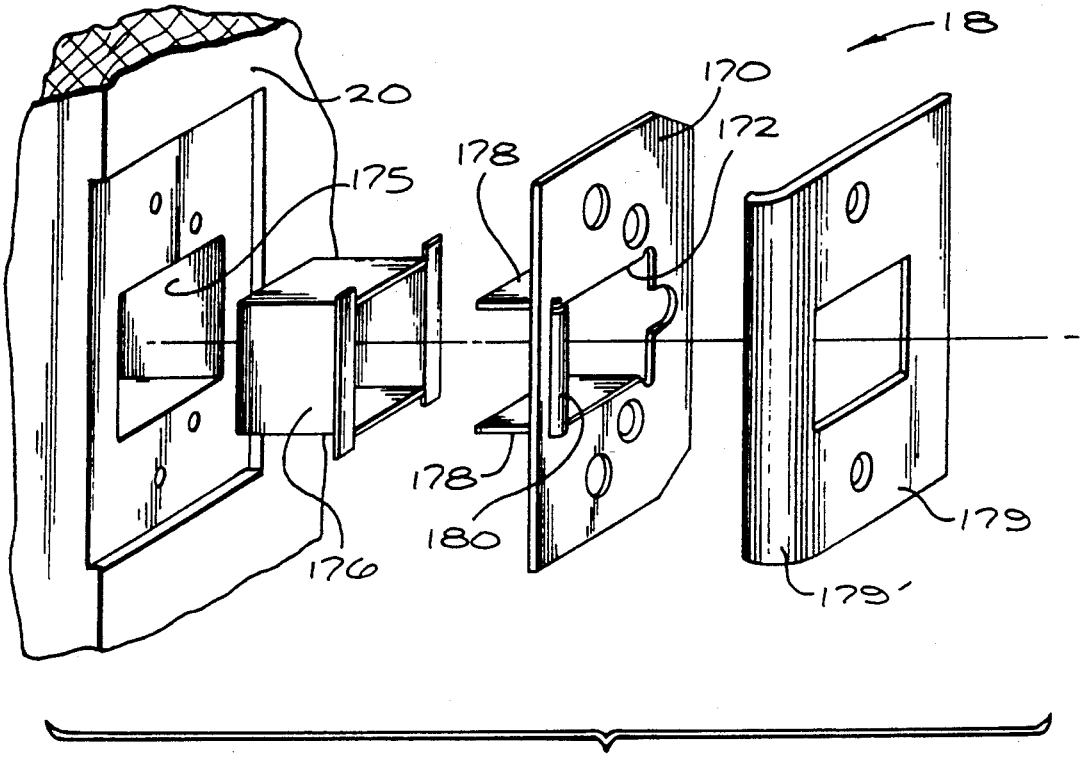
FIG. 19 is an fragmented exploded perspective view depicting one preferred strike set for installation into a door jamb.
Figure 20:
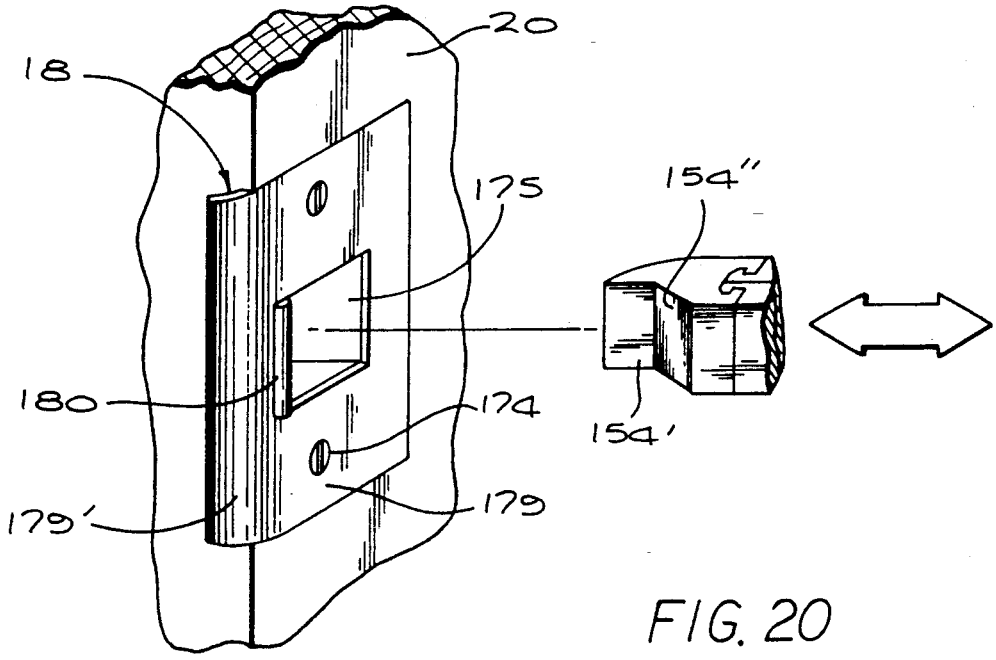
FIG. 20 is a fragmented perspective view illustrating the assembled strike set in exploded relation with a latch bolt for use with the secondary lock cartridges, wherein the latch bolt has a bolt head with an offset latch face.

FIGS. 2, 19 and 20 illustrate a preferred construction for the strike sets 18 associated with each of the three latch bolts. As shown, each strike set includes a strike plate 170 having a bolt port 172 formed therein and adapted for secure fastening onto the adjacent door jamb 20 by means of screws 174. The strike plate 170 is mounted onto the jamb 20 with the bolt port 172 aligned over a bolt recess 175 formed in the door jamb. A bolt receiver box 176 is desirably fitted into the jamb recess 175, with wings 178 or the like on the strike plate 170 holding the receiver box 176 securely in place. An apertured keeper plate 179 is conveniently mounted over the strike plate 170 and includes a curved cam edge 179' for smooth engagement with a curved or otherwise angularly set inboard side face on the associated latch bolt 82 or 154 to depress the latch bolt toward a retracted position as the door is closed, all in a manner known in the art. A guide roller 180 at an outdoor side edge of the bolt port 172 facilitates bolt reception into and withdrawal from the bolt recess 175 during operation of the lock assembly. Alternately, if desired, the curved cam edge 179' may be integrated directly with the strike plate 170.

In the preferred form, the latch bolt 82 associated with the main lock cartridge 34 has an outdoor side face 82' (FIG. 10) extending along the direction of latch bolt throw for secure locking engagement with the associated strike set 18. However, to facilitate engagement of the upper and lower latch bolts 154 with their respective strike sets 18, the bolt heads 160 of the upper and lower latch bolts 154 have outdoor side faces 154' offset in an indoor or inboard direction relative to the side face 82' of the central latch bolt 82. This offset bolt head geometry is shown in FIG. 20, which depicts the bolt head 160 defining a ramped side face 154'' extending forwardly and in an indoor direction to the offset side face 154' oriented to extend along the direction of bolt throw or travel.

Figure 21:
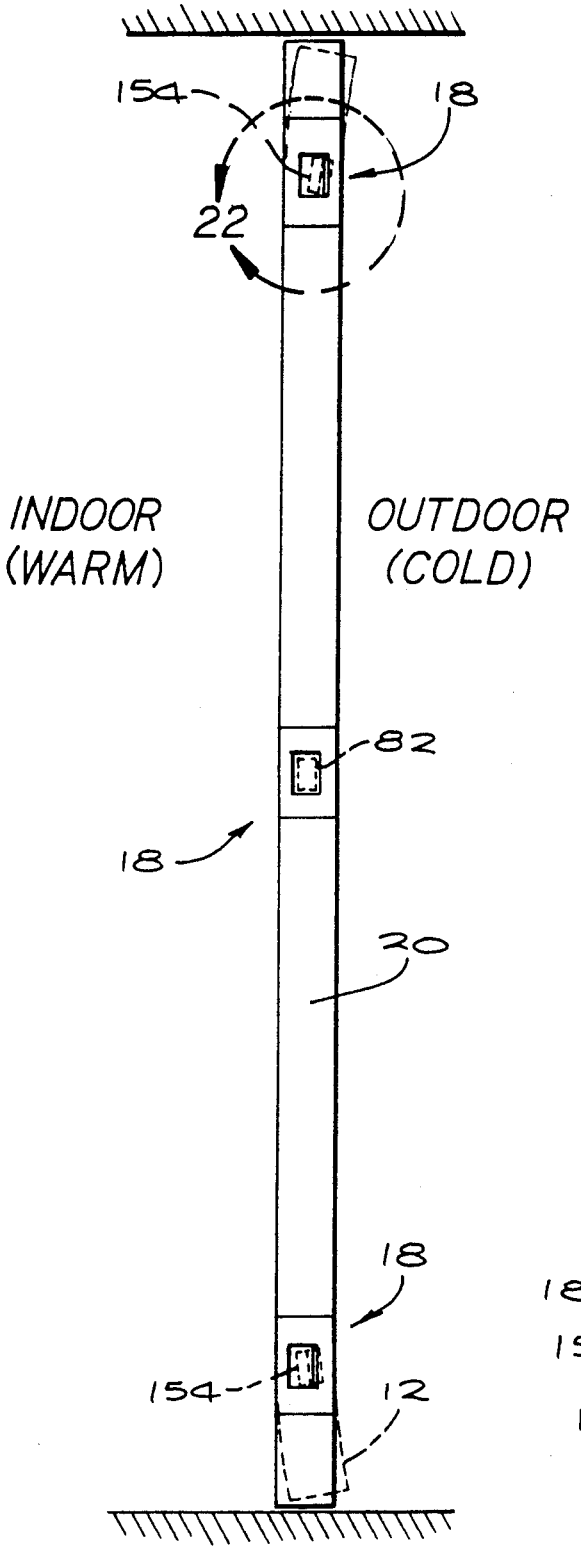
FIG. 21 is a somewhat schematic diagram illustrating use of the improved multipoint door lock assembly of the present invention for secure latching a warped or bowed swinging door.
Figure 22:
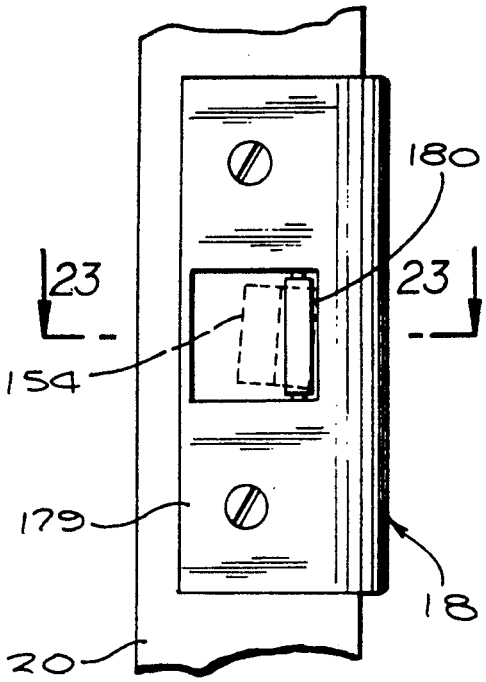
FIG. 22 is an enlarged fragmented edge view of a portion of the door jamb, corresponding generally with the encircled region 22 of FIG. 21.
Figure 23:
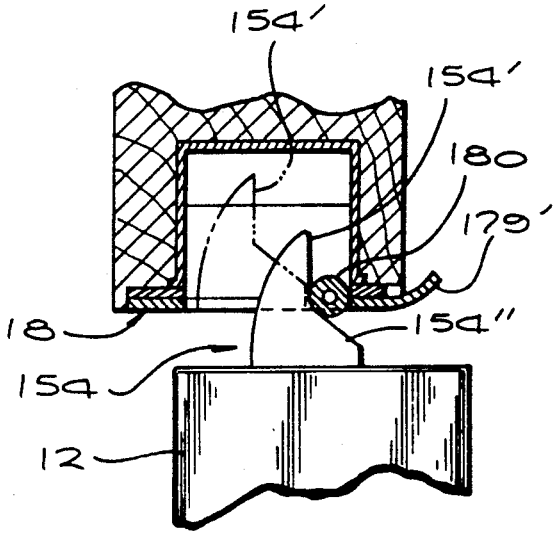
FIG. 23 is an enlarged fragmented horizontal sectional view taken generally on the line 23—23 of FIG. 22.

The offset bolt face geometry for the upper and lower latch bolts 154 is especially useful when the door 12 is bowed or warped to assume an outwardly concave configuration, as viewed somewhat schematically in FIG. 21. Such warping of the door can occur as a result of temperature differentials on the indoor and outdoor door surfaces, or as a result of pressure applied to the door in a closed position by weatherstripping, or simply as a result of aging. When such warped configuration occurs, closure of the door to align the side face 82' of the central latch bolt 82 for reception into the associated strike set 18 would normally fail to move similarly shaped upper and lower latch bolts into engagement with their respective strike sets. By offsetting the side faces 154' of the upper and lower latch bolts 154 in an indoor direction, latch bolt engagement with the strike sets 18 can still occur despite substantial door bow. Moreover, upon operation of the deadbolt mechanisms as previously described to advance all three latch bolts to the deadbolt position, the ramped faces 154'' of the upper and lower latch bolts permit relatively easy advancement of the upper and lower latch bolts to the further extended deadbolt positions, as shown in dotted lines in FIG. 23. This full engagement of the latch bolts in the deadbolt position beneficially assures full and secure door closure, to minimize or eliminate energy loss which might otherwise occur through gaps between the door frame and the warped door.

FIG. 24 illustrates the swinging entry door 12 as part of a double door entry set 26 including an adjacent second or semi-active door 28 which is normally maintained in a closed and locked condition. The multipoint door lock assembly 10 associated with the swinging door 12, constructed as shown and described with respect to FIGS. 1–23, includes the upper and lower latch bolts 154 for selected normal latching or deadbolt engagement with strike sets 18 mounted in a side edge of the semi-active door 28. The header-sill lock assembly 29 includes an integrated strike set 18' for concurrent engagement with the central latch bolt 82 on the main lock cartridge 34. The header-sill lock assembly 29 operates a pair of lock pins 183 and 184 for normal locked engagement with apertured keeper plates 185 and 186 mounted respectively at the header and sill of a door frame. In accordance with the invention, the header-sill lock assembly 29 is disabled in a locked condition when the adjacent mating door 12 is closed to prevent undesired opening of the second, semi-active door 28. However, when the swinging primary door 12 is opened, the header-sill lock assembly 29 can be operated quickly and easily to unlock and permit opening of the semi-active door.

Figure 26:
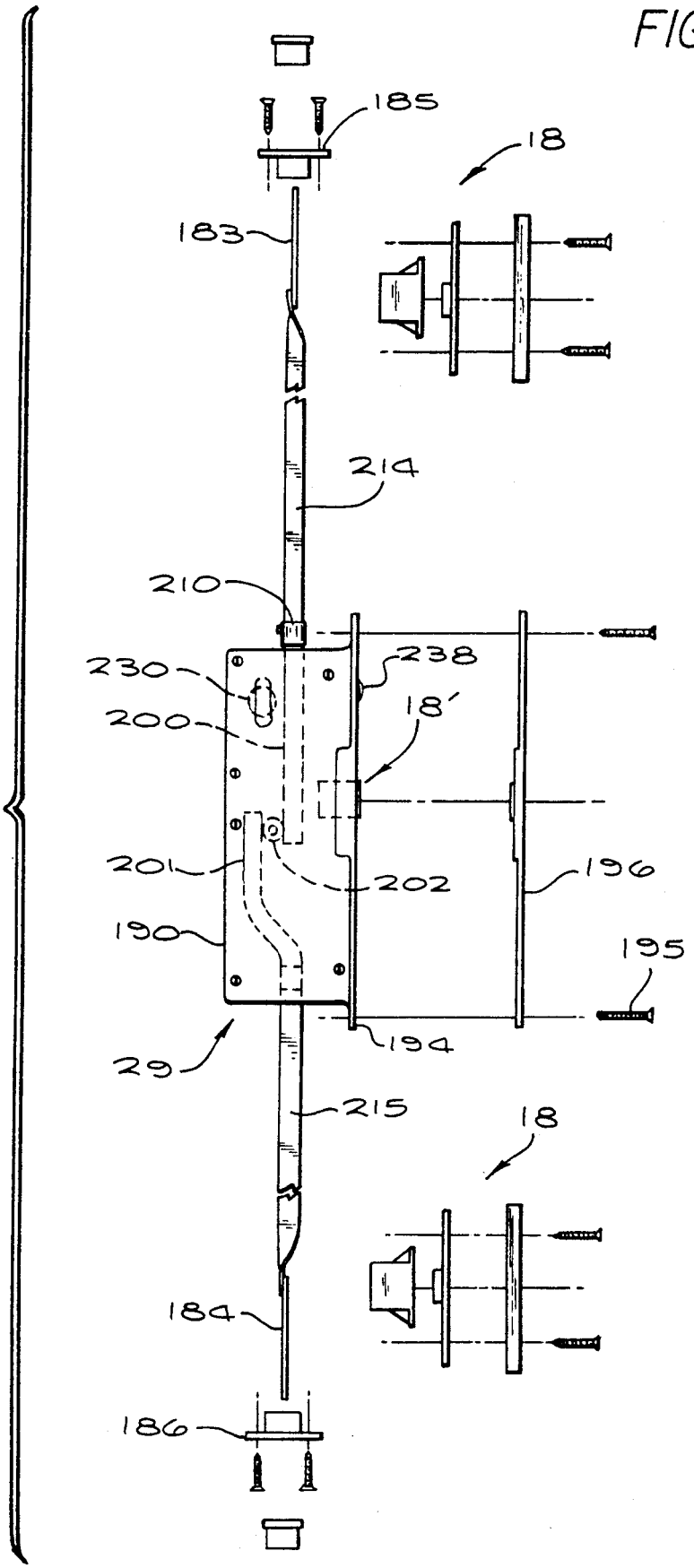
FIG. 26 is a fragmented and somewhat diagrammatic elevational view depicting the header-sill lock assembly.

The components forming the header-sill lock assembly 182 are shown in more detail in FIGS. 25–28. As shown, a central lock cartridge 190 having an overall size and shape generally similar to the main lock cartridge 34 is provided for slide-fit reception into an open-ended chamber 192 formed in the free side edge of the semi-active door 28. The cartridge 190 is conveniently formed from an assembled pair of shell-shaped housing members which may be formed as metal castings or the like. End tabs 194 on the cartridge 190 accommodate secure mounting to the door 28 by means of screws 195 or the like. As shown in FIG. 26, these screws 195 additionally retain a strike or keeper plate 196 on the semi-active door 28, wherein this plate 196 has a bolt port 197 for receiving the latch bolt 82 on the primary door 12.

Figure 27:
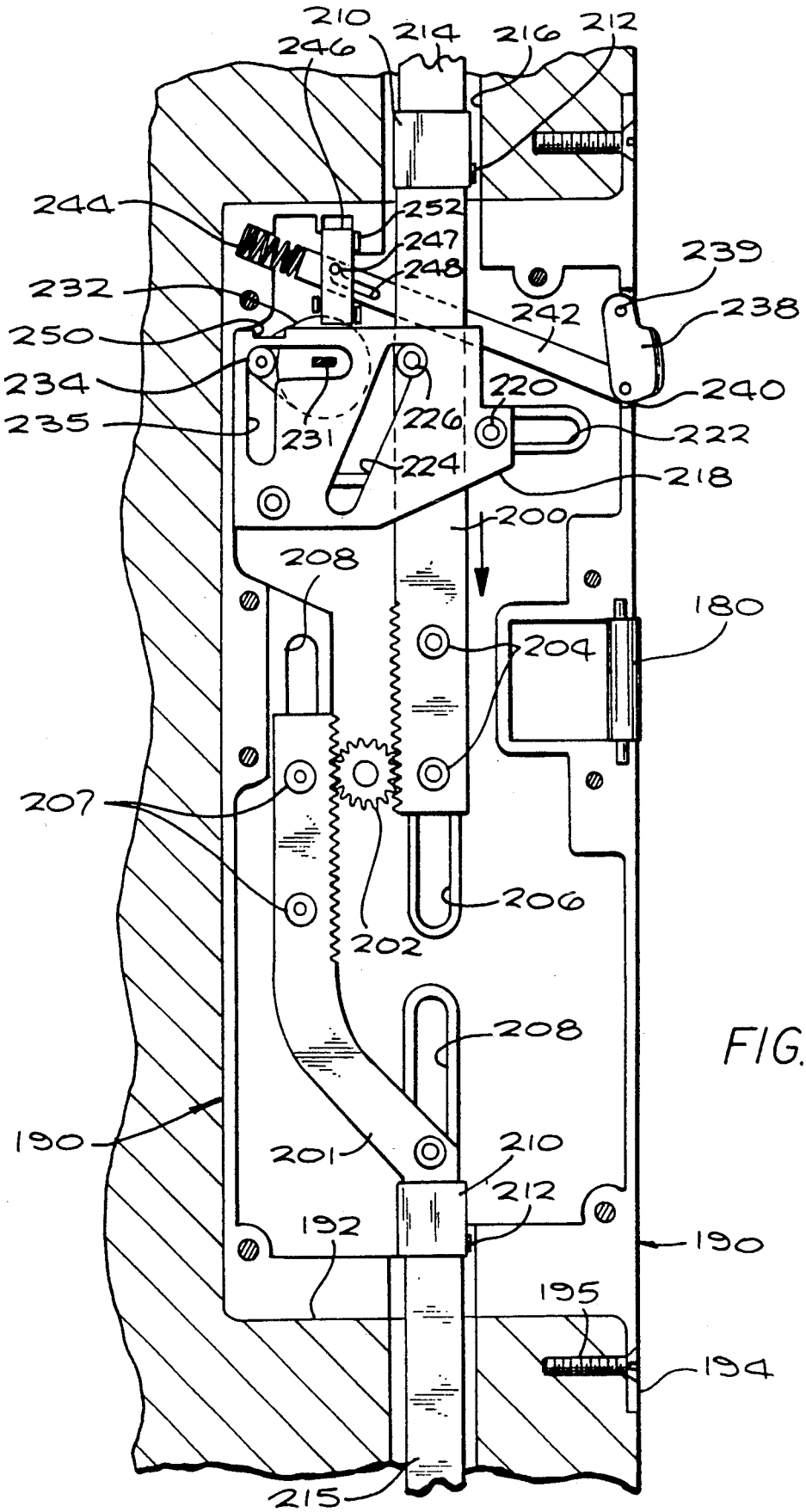
FIG. 27 is an enlarged fragmented vertical sectional view illustrating a central cartridge of the header-sill lock assembly, wherein the central cartridge is in a position permitting unlocking and opening of the second or semi-active door.
Figure 28:
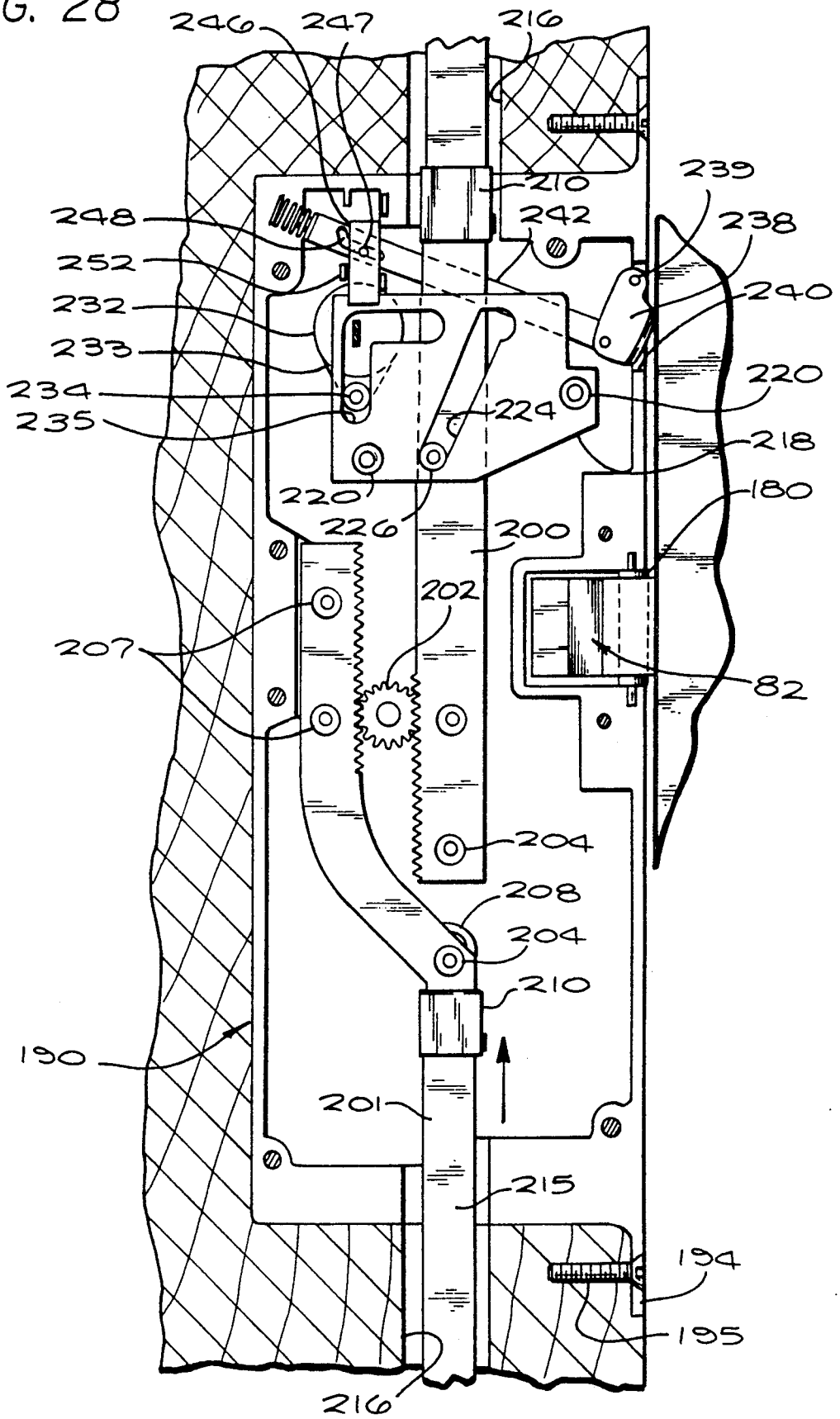
FIG. 28 is a fragmented vertical sectional view similar to FIG. 27, but depicting the header-sill lock assembly in a position retaining the second or semi-active door in a closed and locked condition.

With reference to FIGS. 27 and 28, the central lock cartridge 190 includes a pair of driven racks 200 and 201 in meshed relation with a rotatable spur gear 202. The driven rack 200 includes cam rollers 204 carried within vertical guide tracks 206 within the cartridge 190 to guide the rack through an up-and-down vertical stroke length. Similarly, the other driven rack 201 has cam rollers 207 received into cartridge tracks 208 to guide the rack 201 through a similar vertical stroke. As shown, the rack 200 is connected by a cuff 210 with set screw 212, similar to the connector cuffs 140 as previously described, to an upwardly extending rod 214 having the header pin 183 at the upper end thereof. The second driven rack 201 has a lower end connected via another cuff 210 with set screw 212 to a downwardly extending rod 215 having the sill pin 184 at the lower end thereof. These rods 214 and 215 project through internal channels 216 formed in the door edge, and the lower driven rack 201 conveniently has an offset shape to accommodate in-line mounting of the rods 214, 215. Displacement of one of the rods 214, 215 to extend or retract the associated lock pin 183, 184 is coupled through the gear 202 to achieve a similar movement for the other rod and associated lock pin.

A cam plate 218 is mounted within the cartridge 190 for back-and-forth motion to control the positions of the header and sill lock pins 183 and 184. That is, the cam plate 218 carries guide rollers 220 received into associated guide tracks 222 in the cartridge to permit back-and-forth shifting of the cam plate 218 between two positions. An angled follower track 224 in the cam plate 218 receives a cam roller 226 on the upper driven rack 200. The orientation of this follower track 224 is selected to draw the rack 200 downwardly when the cam plate 218 is displaced toward the door side edge, and vice versa. Downward displacement of the driven rack 200 is effective to retract the header pin 183, and is transmitted through the gear 202 to lift the lower rack 201 for purposes of retracting the sill pin 184. Conversely, upward displacement of the driven rack 200 results in extension of both header and sill pins to a locked position.

A thumbturn 230 mounted on the indoor side of the semi-active door 28 provides a convenient mechanism for displacing the cam plate 218, as described above. As shown in FIGS. 27 and 28, this thumbturn 230 is connected via a tailpiece 231 to a cylindrical actuator 232 mounted within the lock cartridge 190. A laterally projecting side lobe 233 on the actuator 232 carries a cam roller 234 engaged within a vertically oriented segment 235 of an L-shaped cam track formed in the cam plate 218. Accordingly, rotation of the thumbturn 230 displaces the cam plate 218 back-and-forth within the cartridge 190 to control the positions of the header and sill pins 183, 184. In this regard, the thumbturn 230 is normally set to extend the pins 183 and 184 for locking engagement with the associated keeper plates 185, 186 at the door header and sill.

In accordance with one further aspect of the invention, the header-sill lock assembly 182 includes means for positively retaining the assembly in a locked condition unless and until the primary door 12 is opened. That is, whenever the primary door 12 is closed, the semi-active door 28 remains positively locked to prevent inadvertent opening. The thumbturn 230 can be shifted to retract the header-sill lock pins 183, 184 only when the primary door 12 is in an open position.

More specifically, a spring-loaded control button 238 is mounted on a pivot pin 239 to normally protrude through a port 240 at the side edge of the semi-active door 28. This control button 238 is carried at the end of a control link 242 mounted within the cartridge 190 for back-and-forth shifting movement generally along a longitudinal axis thereof. A spring 244 reacts between the control link 242 and the cartridge housing for normally urging the button 238 to protrude from the door side edge (FIG. 27). However, when the adjacent primary door 12 is closed, the edge of the primary door 12 contacts the control button 238 to depress the button and its control link 242 against the spring 244 (FIG. 28).

A latch clip 246 is mechanically coupled to the control link 242 and responds thereto to permit or prevent thumbturn-actuated displacement of the cam plate 218. In the preferred form, the latch clip 246 carries a small pin 247 which is received into a cam track 248 on the control link. When the adjacent primary door 12 is in an open position, the control link 242 is longitudinally extended within the cartridge housing such that the support pin 247 rides within a vertically elevated rear segment of the cam track 248. In this position (FIG. 27), the control link 242 lifts the latch clip 246 for vertical clearance from the underlying cam plate 218, thereby permitting back-and-forth cam plate shifting motion to operate the header-sill pins 183, 184 in response to rotation of the thumbturn 230. However, when the adjacent primary door is closed, the control link 242 is longitudinally retracted within the cartridge housing to reposition the support pin 247 within a lower forward region of the track 248. This repositions the latch clip 246 for seated reception into a notch 250 in the cam plate 218 (FIG. 28), thereby locking the cam plate 218 against shifting movement to retract the header-sill pins 183, 184. Appropriate rails 252 within the cartridge housing guide the latch clip 246 for the desired vertical reciprocation in response to movement of the control link 242.

FIGS. 29–37 illustrate the multipoint door lock assembly of the present invention adapted for use in securely locking a slider door 22. In this embodiment, many of the same components as described previously with respect to the swinging door version of the invention are used. Accordingly, for sake of convenience and ease of description, components corresponding with those previously shown and described herein will be identified by common reference numerals.

In general terms, the slider door 22 has lower rollers 260 for guided movement on a rail or track 261 formed at or within the door sill. A main lock cartridge 262 is installed within one side edge of the door 22 to control the operation of headed lock pins 264 (FIG. 30) associated with remotely mounted secondary lock cartridges 266. Extension rods 24' mounted within preformed channels interconnect the main lock cartridge 262 with the secondary cartridges 266. A thumbturn 48 and a keyed cylinder 44 mounted respectively at the indoor and outdoor sides of the door are provided to operate the lock pins 264, as will be described.

Figure 30:
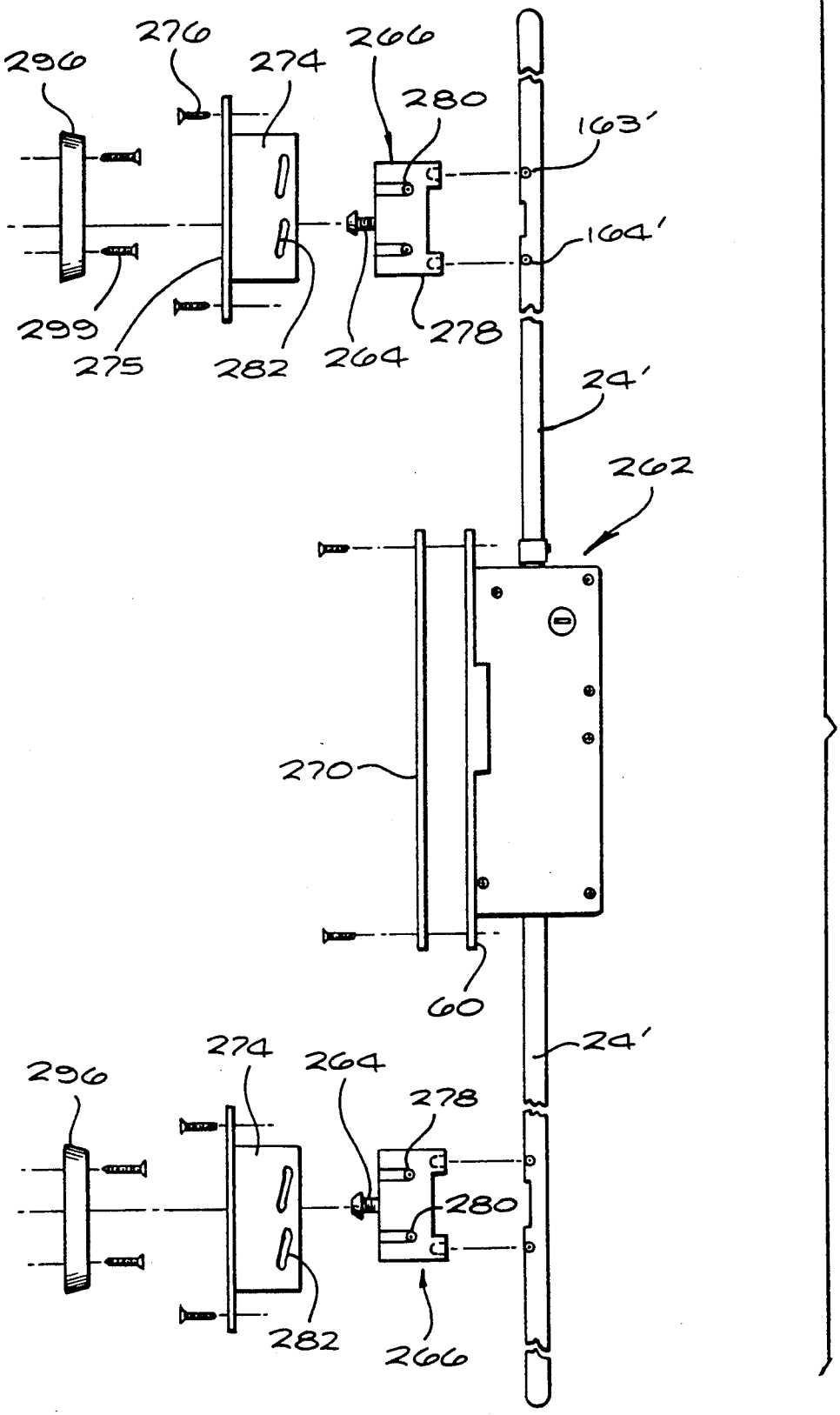
FIG. 30 is a somewhat diagrammatic elevational view depicting the door lock assembly for use in the slider door of FIG. 29, in operative association with keeper plates for mounting onto an adjacent door jamb.
Figure 31:
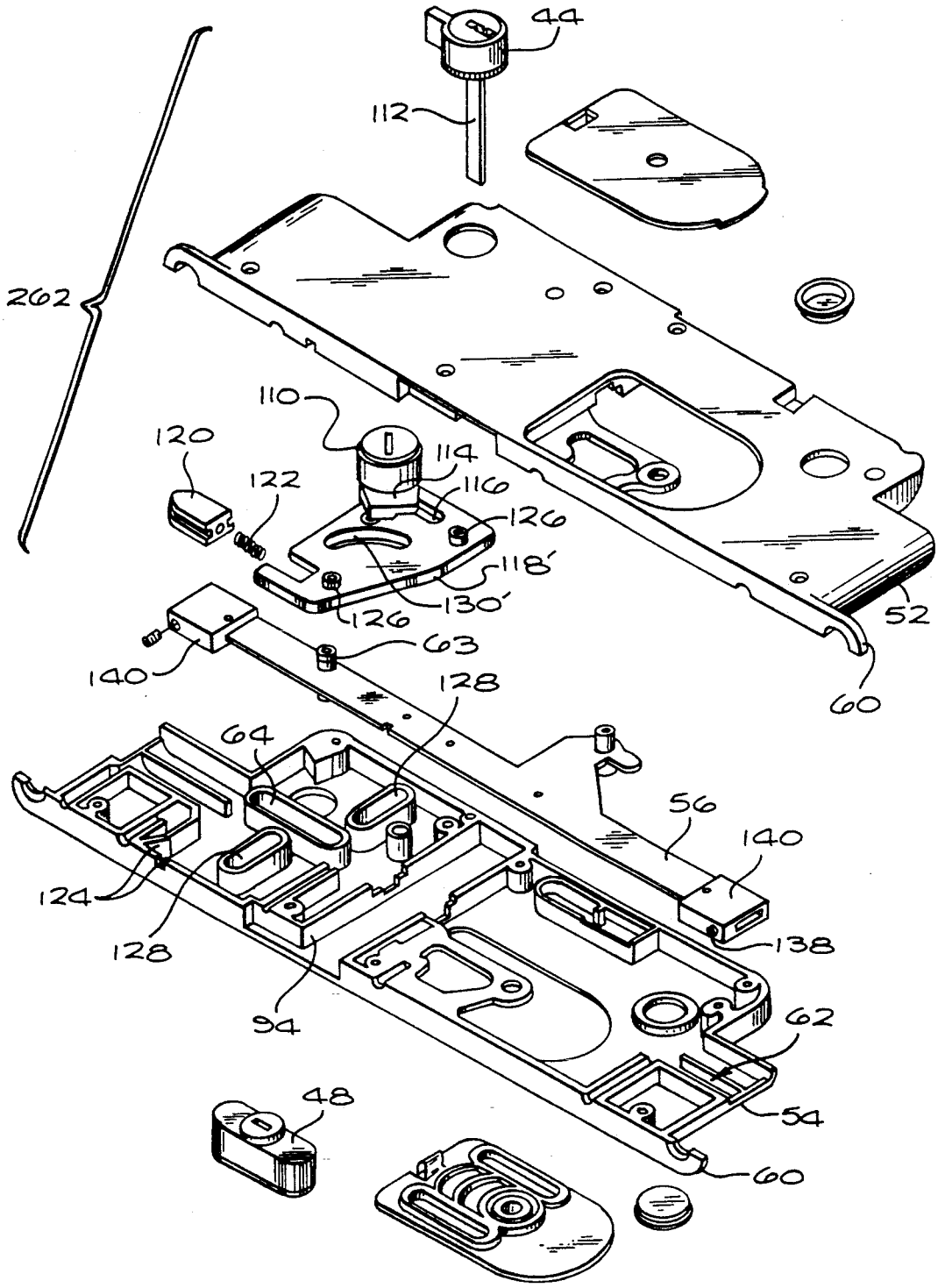
FIG. 31 is an exploded perspective view illustrating the main lock cartridge adapted for use in the slider door of FIG. 29.

As shown in more detail in FIGS. 30 and 31, the main lock cartridge 262 conveniently comprises a compact housing defined by the same assembled housing members 52, 54 used in the swinging door embodiment of FIGS. 1–21. The end tabs 60 on the assembled housing members 52, 54 permit convenient screw-mounted attachment of the cartridge 262 into an open-sided chamber at the side edge of the slider door 22. A blank face plate 270 is provided to overlie the otherwise exposed side edge of the cartridge housing (FIG. 30), thereby closing the bolt track 94 and other access openings applicable to the swinging door embodiment.

The actuator drive bar 56 is again installed within the assembled housing members 52, 54 for vertical reciprocation within the slide track 62. The uppermost cam roller 63 on the drive bar 56 rides within vertically elongated guide tracks 64 on the assembled housing members to constrain the drive bar for vertical reciprocation, all in the same manner as previously described with respect to FIGS. 1–21.

The thumbturn 48 cooperates with the keyed cylinder 44 on the main lock cartridge 262 to shift a modified cam plate 118' back-and-forth within the cartridge housing, for purposes of vertically driving the actuator bar 56. That is, as shown in FIG. 31, the tail piece 112 connected between the thumbturn 48 and the keyed cylinder 44 rotatably operates a cylindrical actuator 110 having a protruding side lobe 114 with a cam roller received into a vertical drive track 116 of the cam plate 118'. Rotational movement of the actuator 110 is effective to shift the cam plate 118' back-and-forth within the cartridge housing, in the same manner as previously described with respect to the swinging door embodiment. Guide rollers 126 on the cam plate 118' ride within guide tracks 128 on the housing members for controlling the direction and magnitude of cam plate shifting movement, while a spring-loaded detent pin 120 engages ramped surfaces 124 on the housing members for springably retaining the cam plate 118' in one of two different shift positions. A follower track 130' in the cam plate 118' receives the cam roller 63 on the drive bar 56, whereby back-and-forth shifting movement of the cam plate 118' results in back-and-forth vertical reciprocation of the drive bar 56. However, in the sliding door embodiment of the invention, the follower track 130' is curved throughout its length to provide smooth drive bar displacement between two discrete positions, without providing a lower linear cam track segment of the type utilized in the swinging door embodiment.

The opposite ends of the drive bar 56 include the connector cuffs 140 and associated set screws 138 for secure attachment to the extension rods 24. As viewed in FIGS. 33 and 34, these extension rods 24' include cam rollers 163' and 164' for slide-fit reception with the secondary lock cartridges 266.

Figure 32:
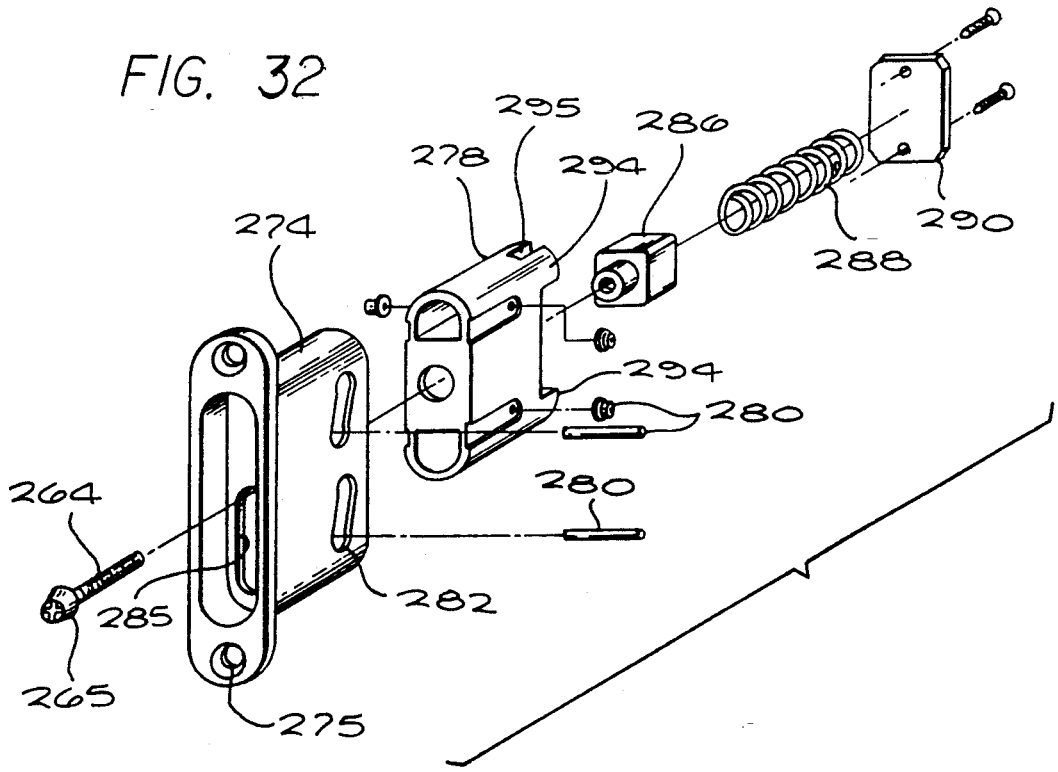
FIG. 32 is an exploded perspective view illustrating a secondary lock cartridge for use in the slider door of FIG. 29.
Figure 33:
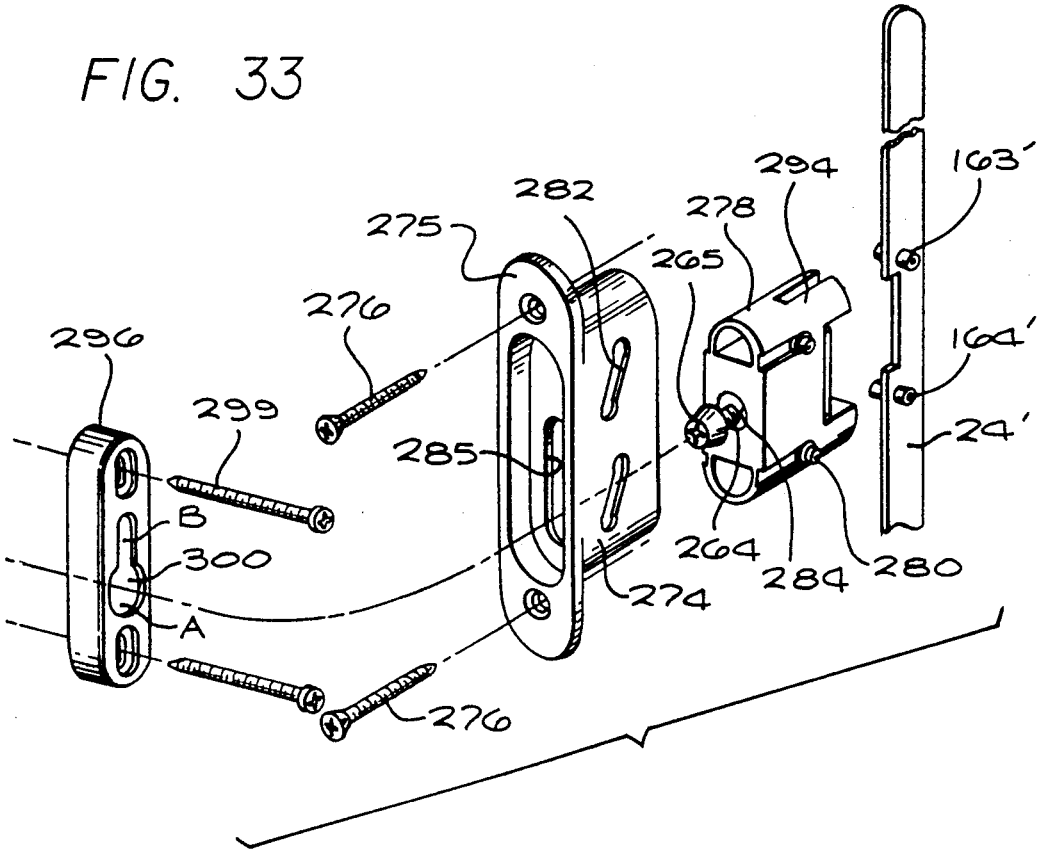
FIG. 33 is another exploded perspective view of the secondary lock cartridge of FIG. 32 shown in partially assembled form, for locking engagement with a keeper plate.
Figure 34:
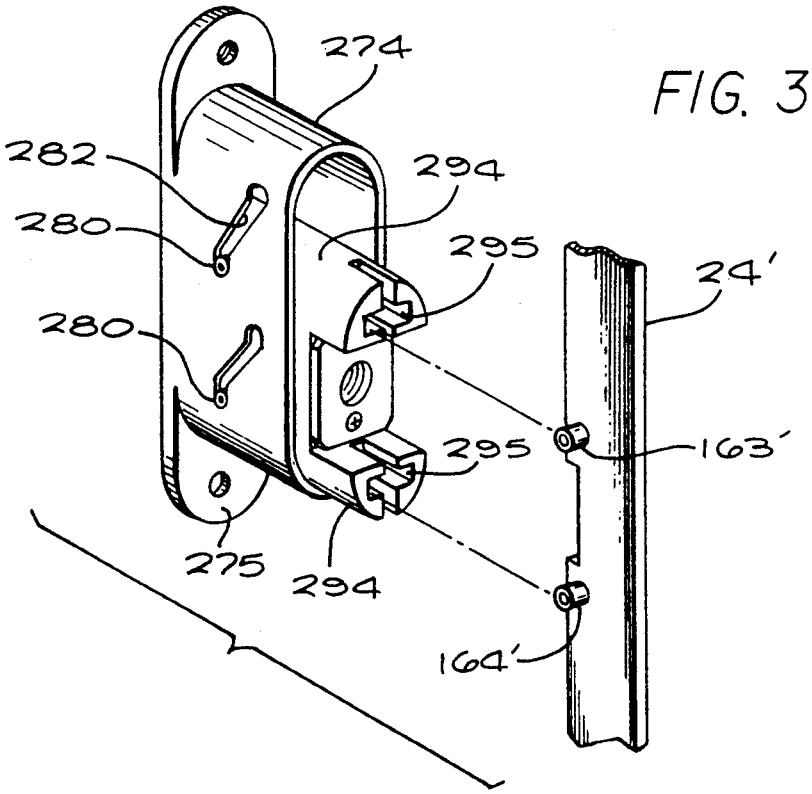
FIG. 34 is an exploded perspective view showing connection of the secondary lock cartridge to an extension rod associated with the main lock cartridge.
Figure 35:
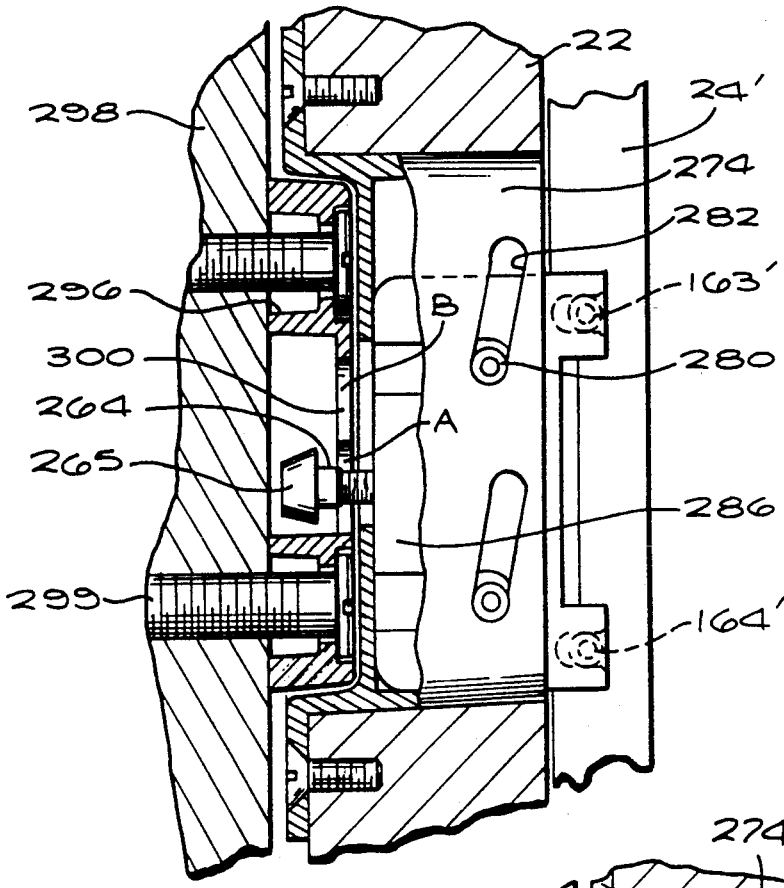
FIG. 35 is a fragmented vertical sectional view illustrating the secondary lock cartridge of FIG. 32 in a closed but unlocked condition.
Figure 36:
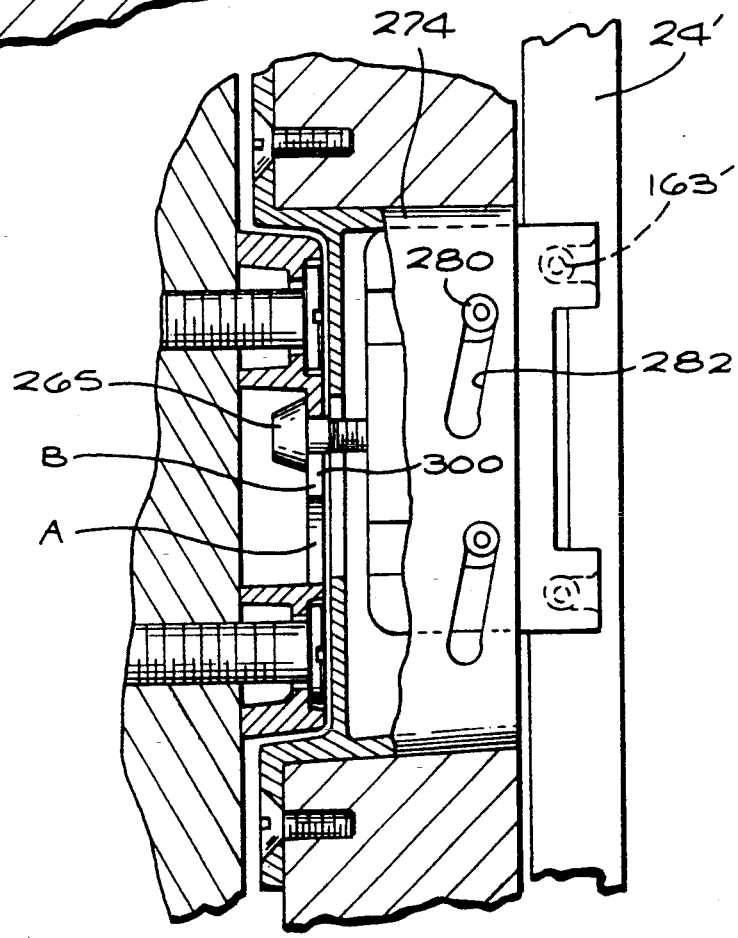
FIG. 36 is an fragmented vertical sectional view illustrating the secondary lock cartridge of FIG. 32 in a closed and locked condition.
Figure 37:
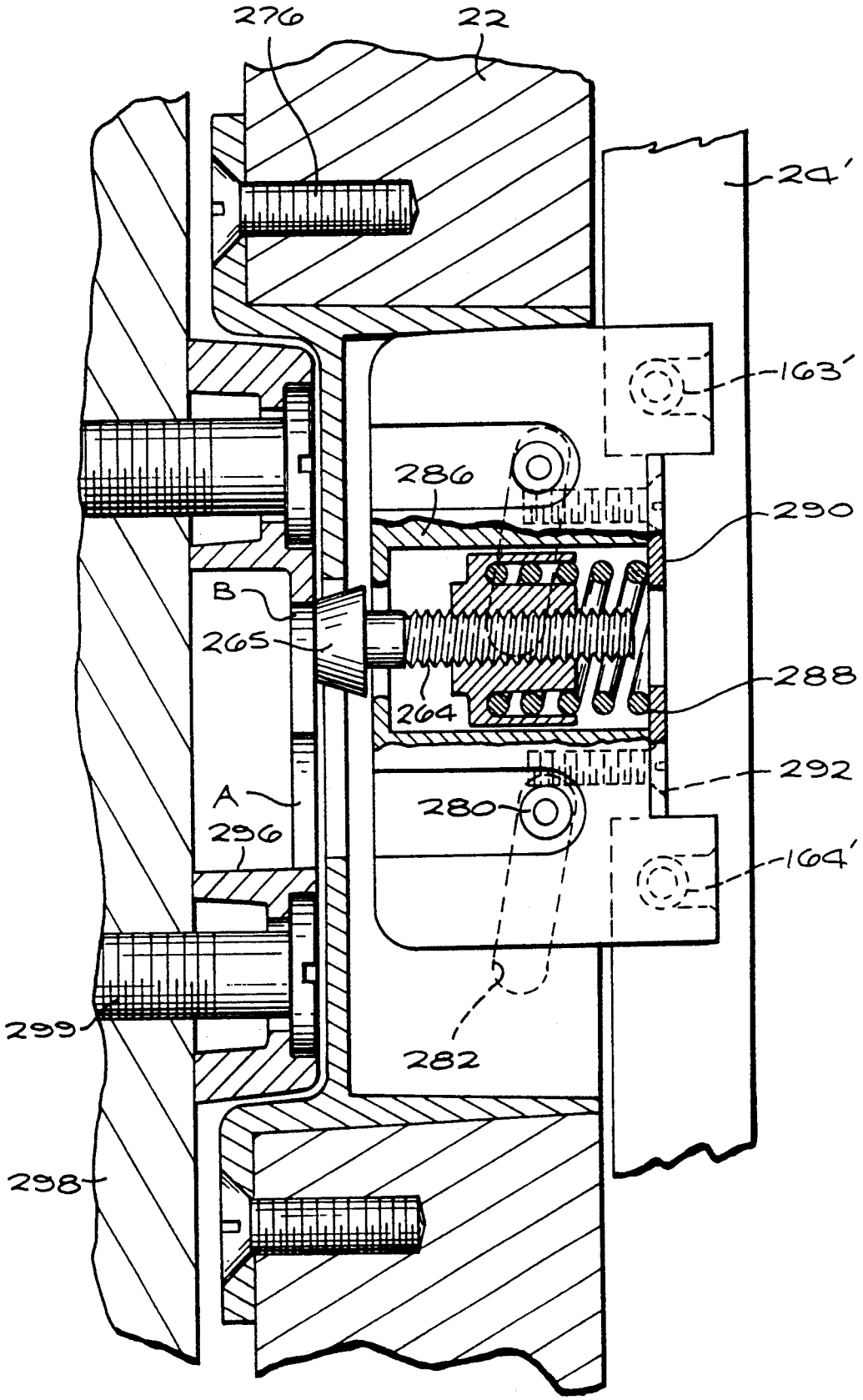
FIG. 37 is a fragmented vertical sectional view showing the secondary lock cartridge of FIG. 32 upon attempted closure of the sliding door with the lock cartridge already positioned in a locked condition.

More specifically, with reference to FIGS. 32–34, each secondary lock cartridge 266 comprises a compact casing 274 with end tabs 275 to accommodate secure fastening into an open-sided pocket at the door side edge by means of screws 276 or the like. The casing 274 is rearwardly open to receive a slide carrier 278 having laterally oriented cam pins 280 received within angularly inclined guide slots 282 formed in the side walls of the casing 274. A lock pin 264 having an enlarged head 265 protrudes from the carrier 278 through a forward port 284 therein, and further through a vertically elongated forward slot 285 in the casing. A rear or base end of the lock pin 264 is threaded into a slide block 286 mounted within the carrier 278. As shown best in FIG. 32, the slide block 286 with lock pin 264 thereon are urged forwardly within the carrier 278 by a compression spring 288 reacting between an aft end of the slide block 286 and a backplate 290 fastened onto a rear end of the slide carrier 278 by screws 292 or the like. A pair of rearwardly projecting mounting legs 294 are formed on the slide carrier 278 and protrude rearwardly beyond the back plate 290 to define drive slots 295 for slide-in reception of the extension rod 24' and the associated drive pins 163' and 164'.

Vertical shifting displacement of the actuator drive bar 56 within the main lock cartridge 262, as previously described, functions to raise or lower the slide carriers 278 of the secondary lock cartridges 266 in a coordinated, concurrent manner. Such vertical displacement of the slide carriers 278 within their respective casings 274 correspondingly displaces the associated lock pins 264. Importantly, the angled orientation of the guide slots 282 causes the slide carriers 278 and the associated lock pins 264 to ride upwardly and rearwardly with a retracting action during vertical lifting motion. This displaces the headed locked pins upwardly and inwardly with respect to a keeper plate 296 on an adjacent door jamb 298. Alternately, if desired, the keeper plates can be mounted at the side edge of an adjacent semi-active door which can be equipped with the header-sill lock assembly described with respect to FIGS. 22–28.

As shown in FIG. 33, the preferred keeper plate 296 is adapted for convenient mounting onto the adjacent door jamb by means of screws 299 or the like. The keeper plate 296 defines a keyhole-shaped keeper port 300 with a generally circular lower segment "A" merged into a vertically extending upper slot segment "B". Accordingly, when the main lock cartridge 262 is operated to place the lock pins 264 in vertically lowered positions, the headed lock pins 264 are oriented for unimpeded reception of the heads 265 through the circular lower segment "A" of the keeper port 300, as viewed in FIG. 35. Thereafter, vertical lifting motion of the lock pins 264 by appropriate operation of the thumbturn 48 on the keyed cylinder 44 is effective to raise the pin heads 265 while retracting the pins inwardly with respect to the slider door 22. This combination movement engages the head 265 within the slotted upper segment "B" of the keeper port 300 and securely against a blind side of the keeper plate 296, thereby and effectively drawing the door 22 to a tightly closed condition, as viewed in FIG. 36. Reverse or downward displacement of the lock pins 264 disengages the lock pin heads 265 from the keeper plates for subsequent door opening.

The spring-loading of the slide block 286 within each secondary lock cartridge 266 conveniently prevents damage to the lock assembly components in the event of attempted door closure with the lock pins 264 in vertically raised positions. For example, as viewed in FIG. 37, such attempted door closure will cause the head 265 on each lock pin 264 to engage the keeper plate in the vicinity of the narrow upper slotted segment "B" of the keeper port, without permitting head reception through the keeper port. Upon such engagement, the spring 288 will compress against the backplate 290, thereby permitting retraction of the lock pin 264 and the associated slide block 286 to prevent damage to the lock assembly components. When the door is released in the condition shown in FIG. 37, the spring 288 will return to an expanded state, thereby springably opening the door a short increment and providing a clear visual indication that the door is not closed. Remedial action can then be taken, namely, downward shifting of the lock pins to permit proper entry into and engagement with the keeper plates. In this regard, the spring-loaded and headed lock pins function in a manner similar to that shown and described in U.S. Pat. No. 4,754,624, which is incorporated by reference herein.

The multipoint door lock assembly of the present invention is thus designed for secure multipoint locking of a door, with minimal modification adapting the lock assembly components for use with a swinging door or a slider door. In either case, the multipoint lock assembly is capable of secure locking engagement with an adjacent fixed door jamb, or with a second, semi-active door of a double door entry set. When a semi-active door is used, a header-sill lock assembly is provided to positively prevent opening of the semi-active door unless the primary door is in an opened condition.

A variety of further modifications and improvements to the present invention will be apparent to those skilled in the art. Accordingly, no limitation on the invention is intended by way of the foregoing description and accompanying drawings, except as set forth in the appended claims.

What is claimed is:

1. A door lock assembly for use in locking a door, said lock assembly comprising:

a main lock cartridge for installation into a side edge of a door, said main lock cartridge including a cartridge housing, an actuator drive bar mounted within said housing for vertical reciprocatory movement, actuator means movably mounted on said housing at a manually accessible position on at least one side of the door, and cam means connected between said actuator means and said drive bar for vertically reciprocating said drive bar in response to manual movement of said actuator means;

at least one secondary lock cartridge for installation into the door side edge at a position remote from said main lock cartridge, said at least one secondary lock cartridge including a lock member adapted to protrude outwardly from the door side edge; and an extension rod for installation slidably within a channel formed in the door side edge and for connection to said actuator drive bar for vertical reciprocation therewith in response to manual movement of said actuator means, said secondary lock cartridge including cam means connected between said extension rod and said lock member for respectively extending and retracting said lock member relative to the door side edge in response to vertical reciprocation of said extension rod;

said lock member of said at least one secondary lock cartridge comprising a latch bolt and spring means for urging said latch bolt from a position retracted within said secondary lock cartridge to a normal latched position protruding from the door side edge, and wherein said actuator means comprises indoor and outdoor handles rotatably mounted on said main lock cartridge, drive links connected between said handles and said drive bar for displacing said latch bolt between the retracted and latched positions in response to handle rotation, said actuator means further including a rotatable member mounted accessibly at an indoor side of the door, said cam means of said main lock cartridge including a cam plate mounted within said cartridge housing and movable in response to rotation of said rotatable member between a first position permitting drive bar movement in response to handle rotation to displace said latch bolt between said retracted and latched positions, and a second position displacing said latch bolt to a further extended, deadbolt position.

2. The door lock assembly of claim 1 wherein the door is a swinging door.

3. The door lock assembly of claim 1 wherein the door is a sliding door.

4. The door lock assembly of claim 1 wherein said at least one secondary lock cartridge comprises a pair of said secondary lock cartridges for installation into the door side edge at positions remote from and respectively above and below said main lock cartridge, said extension rod comprising a pair of extension rods each connected between said drive bar and a respective one of said secondary lock cartridges.

5. The door lock assembly of claim 1 wherein said main lock cartridge further includes a lock member adapted to protrude outwardly from the door side edge, and cam means connected between said drive bar and said lock member of said main lock cartridge for respectively extending and retracting said lock member of said main lock cartridge in response to vertical reciprocation of said drive bar, and concurrently with extension and retraction of said lock member of said secondary lock cartridge.

6. The door lock assembly of claim 1 wherein said drive links associated with said outdoor handle are uncoupled from said drive bar when said latch bolt is in said deadbolt position.

7. The door lock assembly of claim 6 wherein said drive links connected respectively between said drive bar and said handles include reversibly interchangeable indoor and outdoor drive link members.

8. The door lock assembly of claim 6 wherein said latch bolt is reversibly mounted within said secondary lock cartridge.

9. The door lock assembly of claim 6 wherein said main lock cartridge further includes a latch bolt adapted to protrude outwardly from the door side edge, and cam means connected between said drive bar and said latch bolt of said main lock cartridge for respectively extending and retracting said latch bolt of said main lock cartridge in response to vertical reciprocation of said drive bar, and concurrently with extension and retraction of said latch bolt of said secondary lock cartridge.

10. The door lock assembly of claim 9 wherein said latch bolt of said main lock cartridge is reversibly mounted relative to said cartridge housing.

11. The door lock assembly of claim 10 wherein said cartridge housing defines an open-sided bolt track for slide-fit reception of said latch bolt of said main lock cartridge, said bolt track opening at one side edge of said cartridge housing, said cartridge housing defining a shallow recess at said one side edge adjacent to said bolt track, said latch bolt of said main lock cartridge including a bolt base and bolt head cooperatively defining a slide-fit joint for slide-fit interconnection with each other, said slide-fit joint being exposed to said recess when said latch bolt of said main lock cartridge is in said deadbolt position, whereby said bolt head is slidably removable from and slidably re-fittable onto said bolt base to permit bolt head reversal relative to said cartridge housing, said main lock cartridge further including a face plate for mounting over said one side edge of said cartridge housing to prevent removal of said bolt head from said bolt base when said latch bolt of said main lock cartridge is in the deadbolt position.

12. The door lock assembly of claim 1 further including alignment key means for aligned interconnection of said drive bar with said extension rod.

13. The door lock assembly of claim 1 wherein said latch bolt has a bolt head defining a ramped bolt face extending outwardly from the door side edge and angularly in an indoor direction, said ramped bolt face merging with an offset bolt face projecting outwardly therefrom in a direction generally coinciding with the direction of bolt throw.

14. The door lock assembly of claim 1 wherein said at least one secondary lock cartridge comprises a pair of said secondary lock cartridges for installation into the door side edge at positions respectively above and below said main lock cartridge, each of said secondary lock cartridges including one of said lock members in the form of a spring-loaded latch bolt, said main lock cartridge also including a spring-loaded latch bolt protruding outwardly from the door side edge, and cam means connected between said drive bar and said latch bolt of said main lock cartridge for displacing said latch bolt of said main lock cartridge concurrently with said latch bolts of said secondary lock cartridges.

15. The door lock assembly of claim 14 wherein said latch bolt of said main lock cartridge has a latch face at an outdoor side thereof and oriented generally in a direction coinciding with the direction of bolt throw, said latch bolts of said secondary lock cartridges each including a latch face also oriented generally in a direction coinciding with the direction of bolt throw but offset in an inboard direction relative to a plane coinciding with said latch face of the latch bolt of the main lock cartridge.

16. The door latch assembly of claim 1 wherein the door comprises a primary door of a double door entry set having a semi-active door, and further including a header-sill lock assembly on the semi-active door, and means for maintaining the header-sill lock assembly in a positively locked condition unless the primary door is in an open condition.

17. The door lock assembly of claim 1 wherein said at least one secondary lock cartridge comprises a pair of secondary lock cartridges for installation into the door side edge at positions respectively above and below the main lock cartridge, each of said secondary lock cartridges including a lock member in the form of a headed lock pin.

18. The door lock assembly of claim 17 further including a pair of keeper plates each having a keyhole-shaped keeper port formed therein for respectively receiving said headed lock pins.

19. The door lock assembly of claim 17 wherein said cam means of said secondary lock cartridges includes means for extending and retracting said headed lock pins relative to the door side edge.

20. A door lock assembly for use in locking a door, comprising:

a cartridge housing for installation into a side edge of a door;

a latch bolt slidably received within an open-ended bolt track formed in said housing and adapted to protrude outwardly from said bolt track at the door side edge;

indoor and outdoor handles rotatably mounted on said housing at indoor and outdoor sides of the door;

spring means for urging said latch bolt toward a normal latched position protruding outwardly from the door side edge;

drive means coupled between said handles and said latch bolt for displacing said latch bolt from said latched position to a retracted position substantially withdrawn into said cartridge housing upon individual and selective rotation of said handles; and deadbolt means for displacing said latch bolt from said normal latched position to a further protruding deadbolt position whereby said latch bolt serves as a deadbolt, said deadbolt means including means for uncoupling said outdoor handle from said latch bolt when said latch bolt is in the deadbolt position whereby rotation of said outdoor handle with said latch bolt in the deadbolt position is ineffective to retract said latch bolt from the deadbolt position, said indoor handle remaining coupled with said latch bolt when said latch bolt is in the deadbolt position whereby rotation of said indoor handle is effective to retract said latch bolt from the deadbolt position;

said drive means including indoor and outdoor drive links associated respectively with said indoor and outdoor handles, said indoor and outdoor drive links having a different size and being interchangeably mounted.

21. The door lock assembly of claim 20 wherein said cartridge housing includes removably mounted access plates on opposite sides thereof to permit access to and removable mounting of said indoor and outdoor drive links.

22. The door lock assembly of claim 20 wherein said latch bolt includes a bolt head reversibly mounted with respect to said cartridge housing.

23. The door lock assembly of claim 20 further including a secondary lock cartridge for installation into the door side edge at a position remote from said cartridge housing, said secondary lock cartridge including a latch bolt slidably received within a bolt track and adapted to protrude outwardly from the door side edge, and actuator means coupled between said latch bolt of said secondary lock cartridge and said drive means for displacing said latch bolt of said secondary lock cartridge to retracted, latched and deadbolt positions concurrently with the latch bolt of said cartridge housing.

24. The door lock assembly of claim 20 further including a pair of secondary lock cartridges for installation into the door side edge at positions remote from said cartridge housing, said secondary lock cartridges each including a latch bolt slidably received within a bolt track and adapted to protrude outwardly from the door side edge, and actuator means coupled between said latch bolts of said secondary lock cartridges and said drive means for displacing said latch bolts of said secondary lock cartridges to retracted, latched and deadbolt positions concurrently with the latch bolts of said cartridge housing.

25. A door lock assembly for use in locking a door, comprising:

a main lock cartridge for installation into a side edge of a door;

a secondary lock cartridge for installation into the door side edge at a position remote from said main lock cartridge;

a latch bolt slidably received into an open-ended bolt track formed in said secondary lock cartridge and adapted to protrude outwardly from said bolt track at the door side edge;

indoor and outdoor handles rotatably mounted on said main lock cartridge respectively at indoor and outdoor sides of the door;

spring means for urging said latch bolt toward a normal latched position protruding outwardly from the door side edge;

drive means coupled between said handles and said latch bolt for displacing said latch bolt from said latched position to a retracted position substantially withdrawn into said secondary lock cartridge upon individual and selective rotation of said handles; and deadbolt means for displacing said latch bolt from said normal latched position to a further protruding deadbolt position whereby said latchbolt serves as a deadbolt, said deadbolt means including means for uncoupling said outdoor handle from said latch bolt when said latch bolt is in the deadbolt position whereby rotation of said outdoor handle with said latch bolt in the deadbolt position is ineffective to retract said latch bolt from the deadbolt position, said indoor handle remaining coupled with said latch bolt when said latch bolt is in the deadbolt position whereby rotation of said indoor handle is effective to retract said latch bolt from the deadbolt position.

26. The door lock assembly of claim 25 wherein said lock assembly includes a pair of said secondary lock cartridges each including a latch bolt coupled by said drive means to said indoor and outdoor handles.

27. A door lock assembly for use in locking a door, comprising:

a main lock cartridge for installation into an open-ended chamber formed in a side edge of a door, said main lock cartridge including an actuator drive bar constrained for reciprocal movement along a slide track;

actuator means mounted on said main lock cartridge and accessible from at least one of indoor and outdoor sides of the door for manually displacing said drive bar along said slide track;

a secondary lock cartridge for installation into an open-ended pocket formed in the door side edge at a position remote from said main lock cartridge, said secondary lock cartridge including a lock member supported for movement between latched and unlatched positions relative to the door side edge, and cam means for displacing said lock member between said latched and unlatched positions;

an extension rod for sliding installation into a channel formed in the door side edge to extend generally between said drive bar and said secondary lock cartridge, said extension rod being coupled to said cam means for moving said lock member between the latched and unlatched positions in response to sliding movement of said extension rod along the channel;

alignment key means for temporarily retaining said drive bar and said extension rod in preset positions; and connector means for connecting said drive bar to said extension rod while said bar and rod are in said preset positions.

28. The door lock assembly of claim 27 including a pair of said secondary lock cartridges, and a pair of said extension rods associated respectively with said pair of secondary lock cartridges, said alignment key means retaining said drive bar and said pair of extension rods in preset positions, and said connector means connecting said drive bar to both of said connector rods.

29. The door lock assembly of claim 27 wherein said main lock cartridge includes a lock member supported for movement between latched and unlatched positions relative to the door side edge, and cam means coupled between said drive bar and said lock member of said main lock cartridge for displacing same between the latched and unlatched positions concurrently with the lock member of said secondary lock cartridge.

30. The door lock assembly of claim 27 wherein said alignment key means comprises a pair of alignment keys receivable respectively through ports formed in the main and secondary lock cartridges for engagement into notches formed respectively in said drive bar and said extension rod.

31. The door lock assembly of claim 30 wherein said connector means comprises a connector cuff mounted on one of said drive bar and extension rod for slide-fit reception of the other of said drive bar and extension rod, set screw means on said connector cuff for securely retaining said drive bar and extension rod in binding relation with each other, and a port formed in said main lock cartridge to permit reception of a wrench for tightening said set screw means.

32. The door lock assembly of claim 31 further including a face plate, and a screw for reception into said port for mounting said face plate onto the main lock cartridge.

33. The door lock assembly of claim 27 wherein said drive bar and said extension rod include interengaging serrated teeth.

34. A door lock assembly for use in locking a door, comprising:

a cartridge housing for installation into an open-ended chamber formed in a side edge of a door, said cartridge housing defining an open-ended bolt track;

a latch bolt slidably received into said bolt track for movement therein between latched and unlatched positions, said latch bolt including a bolt base and a bolt head cooperatively defining a slide-fit joint to permit reversible slide-fit mounting of said bolt head onto said bolt base by displacement of said bolt head relative to said bolt base in a direction different from the direction of latch bolt travel between said latched and unlatched positions;

said cartridge housing defining a recess disposed adjacent to the open end of said bolt track, said recess having a sufficient depth to expose said slide-fit joint when said latch bolt is in the latched position and thereby permit removal and reversible reinstallation of said bolt head relative to said bolt base;

a face plate for removable mounting onto said cartridge housing, said face plate having a bolt port formed therein to permit sliding passage of said bolt head, said face plate closing said recess in said cartridge housing whereby said slide-fit joint is unexposed to prevent removal of said bolt head from said bolt base when said latch bolt is in the latched position with said face plate mounted on said cartridge housing; and means for displacing said latch bolt between the latched and unlatched positions.

35. The door lock assembly of claim 34 wherein said slide-fit joint is a dovetail joint.

36. The door lock assembly of claim 1 wherein said rotatable member comprises a thumbturn.

* * * * *